US007471270B2

(12) United States Patent
Tomohara

(10) Patent No.: US 7,471,270 B2
(45) **Date of Patent: *Dec. 30, 2008**

(54) DISPLAY CONTROLLER, DISPLAY SYSTEM, AND DISPLAY CONTROL METHOD

(75) Inventor: Kiyohide Tomohara, Hino (JP)

(73) Assignee: Seiko Epson Corporation (JP)

( * ) Notice: Subject to any disclaimer, the term of this patent is extended or adjusted under 35 U.S.C. 154(b) by 586 days.

This patent is subject to a terminal disclaimer.

(21) Appl. No.: 11/043,024

(22) Filed: Jan. 25, 2005

(65) Prior Publication Data

US 2005/0184933 A1 Aug. 25, 2005

(30) Foreign Application Priority Data

Jan. 26, 2004 (JP) ..... 2004-017310

(51) Int. Cl.
*G09G 3/30* (2006.01)

(52) U.S. Cl. ..... 345/77; 345/76; 345/213

(58) Field of Classification Search ..... 345/76–104, 345/204, 213, 212, 690–693; 315/169.3
See application file for complete search history.

(56) References Cited

U.S. PATENT DOCUMENTS 6,366,026 B1 * 4/2002 Saito et al. ..... 315/169.3
6,906,706 B2 * 6/2005 Kosaka et al. ..... 345/211
2004/0263540 A1 * 12/2004 Ooishi et al. ..... 345/690

FOREIGN PATENT DOCUMENTS

| | | |
|---|---|---|
| JP | 08-095531 | 4/1996 |
| JP | 10-023359 | 1/1998 |
| JP | 11-73159 | 3/1999 |
| JP | 11-109921 | 4/1999 |
| JP | 2001-350452 | 12/2001 |
| JP | 2003-015613 | 1/2003 |
| JP | 2003-044015 | 2/2003 |

* cited by examiner

*Primary Examiner*—Jimmy H Nguyen
(74) *Attorney, Agent, or Firm*—Harness, Dickey & Pierce, P.L.C.

(57) ABSTRACT

A display controller includes a blanking adjustment signal generation section which generates first and second horizontal blanking adjustment signals for respectively setting first and second horizontal blanking periods; first and second horizontal blanking period setting registers in which periods until the first and second horizontal blanking adjustment signals change are respectively set; and a grayscale clock signal generation section which generates first and second grayscale clock signals, which have first to N-th grayscale pulses within predetermined periods specified by the first and second horizontal blanking adjustment signals, respectively. The first horizontal blanking adjustment signal and the first grayscale clock signal are output to the first data driver, and the second horizontal blanking adjustment signal and the second grayscale clock signal are output to the second data driver.

9 Claims, 33 Drawing Sheets

FIG. 20A

| XRST | CLK | XCLR | LD | E | LOAD VALUE | CURRENT | NEXT | NOTE |
|---|---|---|---|---|---|---|---|---|
| 0 | — | — | — | — | — | — | 6 | RESET |
| 1 | ↑ | 0 | — | — | — | — | 6 | INITIAL VALUE LOAD |
| 1 | ↑ | 1 | 1 | — | HT | HCNT | HT | SET VALUE LOAD |
| 1 | ↑ | 1 | 0 | 1 | HT | HCNT | HCNT-1 | COUNTDOWN |
| 1 | ↑ | 1 | 0 | 0 | HT | HCNT | HCNT | HOLD |
| OTHER CONDITIONS | | | | | HT | HCNT | HCNT | HOLD |

FIG. 20B

| XRST | CLK | XCLR | LD | E | LOAD VALUE | CURRENT | NEXT | NOTE |
|---|---|---|---|---|---|---|---|---|
| 0 | — | — | — | — | — | — | 0 | RESET |
| 1 | ↑ | 0 | — | — | — | — | 0 | INITIAL VALUE LOAD |
| 1 | ↑ | 1 | 1 | — | SIZY | VCNT | SIZY | SET VALUE LOAD |
| 1 | ↑ | 1 | 0 | 1 | SIZY | VCNT | VCNT-1 | COUNTDOWN |
| 1 | ↑ | 1 | 0 | 0 | SIZY | VCNT | VCNT | HOLD |
| OTHER CONDITIONS | | | | | SIZY | VCNT | VCNT | HOLD |

FIG. 20C

| SIGNAL NAME | CONDITION |
|---|---|
| HCNT_E | DCLK_EB=1 |
| HCNTLD | HCNT=0 AND DCLK_EB=1 |
| VCNTLD | VCNT=0 AND HCNT=0 AND DCLK_EB=1 |

FIG. 24A

| XRESET | CLK | PINFENB | DCLK_EB | HCNT | DM | NOTE |
|---|---|---|---|---|---|---|
| 0 | — | — | — | — | 0 | RESET |
| 1 | ↑ | 0 | — | — | 0 | INITIAL VALUE LOAD |
| 1 | ↑ | 1 | 1 | HCNT=1 | 1 | DCLK MASK CANCELLATION |
| OTHER CONDITIONS | | | | | HOLD | HOLD |

FIG. 24B

| XRESET | CLK | PINFENB | DCLK_EB | DM | LPM | NOTE |
|---|---|---|---|---|---|---|
| 0 | — | — | — | — | 0 | RESET |
| 1 | ↑ | 0 | — | — | 0 | INITIAL VALUE LOAD |
| 1 | ↑ | 1 | 1 | 1 | 1 | LP MASK CANCELLATION |
| OTHER CONDITIONS | | | | — | HOLD | HOLD |

FIG. 24C

| SIGNAL NAME | CONDITION |
|---|---|
| dec_lpa | HCNT=0 AND LPM=0 |
| dec_lpb | HCNT≦OFFSET AND LPM=0 |
| dec_yd | HCNT≦IDLTIM AND VCNT=SIZY |

FIG. 27

| SIGNAL NAME | CONDITION |
|---|---|
| DIS1A_LTRG | HCNT=HT−DIS1A |
| DIS1B_LTRG | HCNT=HT−DIS1B |
| DIS2A_LTRG | HCNT=HT−DIS2A |
| DIS2B_LTRG | HCNT=HT−DIS2B |
| DIS1A_HTRG | HCNT=1+OFFSET |
| DIS1B_HTRG | HCNT=1+OFFSET×2 |
| DIS2A_HTRG | HCNT=1 |
| DIS2B_HTRG | HCNT=1+OFFSET |

FIG. 32A

| XRST | CLK | XCLR | LD | E | LOAD VALUE | CURRENT | NEXT | NOTE |
|---|---|---|---|---|---|---|---|---|
| 0 | — | — | — | — | — | — | 0 | RESET |
| 1 | ↑ | 0 | — | — | — | — | 0 | COUNT STOP |
| 1 | ↑ | 1 | 1 | — | G | GCNT1 | G | SET VALUE LOAD |
| 1 | ↑ | 1 | 0 | 1 | G | GCNT1>0 | GCNT1-1 | COUNTDOWN |
| 1 | ↑ | 1 | 0 | 0 | G | GCNT1 | GCNT1 | HOLD |
| OTHER CONDITIONS | | | | | G | GCNT1 | GCNT1 | HOLD |

FIG. 32B

| XRST | CLK | XCLR | LD | E | LOAD VALUE | CURRENT | NEXT | NOTE |
|---|---|---|---|---|---|---|---|---|
| 0 | — | — | — | — | — | — | 15 | RESET |
| 1 | ↑ | 0 | — | — | — | — | 15 | INITIAL VALUE LOAD |
| 1 | ↑ | 1 | 1 | — | LDVALUE | GCNT2 | LDVALUE | SET VALUE LOAD |
| 1 | ↑ | 1 | 0 | 1 | LDVALUE | GCNT2<15 | GCNT2+1 | COUNTUP |
| 1 | ↑ | 1 | 0 | 0 | LDVALUE | GCNT2 | GCNT2 | HOLD |
| OTHER CONDITIONS | | | | | LDVALUE | GCNT2 | GCNT2 | HOLD |

FIG. 32C

| SIGNAL NAME | CONDITION |
|---|---|
| GCNT1LD | (CNTSTART=1 OR (GCNT2≠15 AND GCNT1=0)) AND ENB=1 |
| GCNT1_E | GCNT2≠15 AND ENB=1 |
| GCNT2LD | (CNTSTART=1 OR (GCNT1=0 AND G=0)) AND ENB=1 |
| PREGCLK | GCNT1=1 |

DISPLAY CONTROLLER, DISPLAY SYSTEM, AND DISPLAY CONTROL METHOD

Japanese Patent Application No. 2004-17310, filed on Jan. 26, 2004, is hereby incorporated by reference in its entirety.

BACKGROUND OF THE INVENTION

The present invention relates to a display controller, a display system, and a display control method.

In recent years, a display device using an electroluminescent (EL) element has attracted attention. In particular, since an organic EL panel including an EL element formed using a thin film of an organic material is a self-emission type, a backlight becomes unnecessary, whereby a wide viewing angle is implemented. Moreover, since the organic EL panel has a high response speed in comparison with a liquid crystal panel, a color video display can be easily implemented using a simple configuration.

The organic EL panel is divided into a simple matrix type and an active matrix type in the same manner as the liquid crystal panel. When driving a simple matrix type organic EL panel, grayscale control may be performed using pulse width modulation (hereinafter abbreviated as "PWM". A display controller performs grayscale control by outputting control signals to drivers (data driver and scan driver) which drive the organic EL panel.

The data lines of the organic EL panel may be driven using a plurality of data drivers. The data drivers are cascade-connected. Display data and various synchronization signals are supplied to the cascade-connected data drivers from the display controller.

Suppose the case where each of the data drivers performs a PWM drive in which grayscale control is performed corresponding to the pulse width within a predetermined period within one horizontal scan period, for example. In the case where the number of data lines of the organic EL panel driven by each of the data drivers is the same (96×3, for example), horizontal display periods in which grayscale control using PWM can be performed are approximately the same. However, since the manufacturing technology of the organic EL panel is immature differing from the liquid crystal panel, the color tone to be represented may differ to only a small extent depending on the product variation. In this case, since the horizontal display period differs for each data driver, the color tone represented by grayscale control differs in each display region driven by each of the data drivers.

In the case where the number of data lines driven by each of the data drivers differs (96×3 and 48×3, for example), the horizontal display period also differs. Therefore, the color tone represented by grayscale control differs in each display region driven by each of the data drivers if the horizontal display period cannot be changed for each data driver.

Therefore, it is preferable that the display controller which controls such data drivers be able to change the horizontal display period for each data driver.

BRIEF SUMMARY OF THE INVENTION

A first aspect of the present invention relates to a display controller for controlling first and second data drivers which drive data lines of a display panel including a plurality of scan lines and the data lines, the display controller including:

a blanking adjustment signal generation section which generates first and second horizontal blanking adjustment signals for respectively setting first and second horizontal blanking periods which have pulses of first and second latch pulse signals, respectively, each of the pulses specifying one horizontal scan period of one of the first and second horizontal blanking periods;

first and second horizontal blanking period setting registers in which periods from a start timing of one horizontal scan period until the first and second horizontal blanking adjustment signals change are respectively set; and a grayscale clock signal generation section which generates a first grayscale clock signal and a second grayscale clock signal, the first grayscale clock signal having first to N-th (N is an integer larger than one) grayscale pulses within a predetermined period specified by the first horizontal blanking adjustment signal, and the second grayscale clock signal having first to N-th grayscale pulses within a predetermined period specified by the second horizontal blanking adjustment signal, wherein the blanking adjustment signal generation section changes the first horizontal blanking adjustment signal when a period corresponding to a value set in the first horizontal blanking period setting register has elapsed from the start timing, and changes the second horizontal blanking adjustment signal when a period corresponding to a value set in the second horizontal blanking period setting register has elapsed from the start timing, and wherein the display controller outputs the first horizontal blanking adjustment signal and the first grayscale clock signal to the first data driver which drives the data lines by using a signal that has been pulse-width-modulated based on the first horizontal blanking adjustment signal and the first grayscale clock signal, and outputs the second horizontal blanking adjustment signal and the second grayscale clock signal to the second data driver which drives the data lines by using a signal that has been pulse-width-modulated based on the second horizontal blanking adjustment signal and the second grayscale clock signal.

A second aspect of the present invention relates to a display system including:

a display panel which includes:

a plurality of scan lines;

a plurality of data lines; and a plurality of electroluminescent elements, each of the electroluminescent elements being specified by one of the scan lines and one of the data lines;

a scan driver which scans the scan lines;

first and second data drivers which drive the data lines; and the above display controller, wherein the display controller outputs the first horizontal blanking adjustment signal and the first grayscale clock signal to the first data driver, and outputs the second horizontal blanking adjustment signal and the second grayscale clock signal to the second data driver.

A third aspect of the present invention relates to a display system including:

a display panel which includes:

a plurality of scan lines;

a plurality of data lines; and a plurality of electroluminescent elements, each of the electroluminescent elements being specified by one of the scan lines and one of the data lines;

first and second scan driver which scans the scan lines;

first and second data drivers which drive the data lines; and the above display controller, wherein the display controller outputs the first and second horizontal blanking adjustment signals respectively to the first and second data drivers, and outputs the first and second vertical blanking adjustment signals respectively to the first and second scan drivers, and wherein the electroluminescent elements are discharged based on the first and second horizontal blanking adjustment signals and the first and second vertical blanking adjustment signals.

A fourth aspect of the present invention relates to a display control method for controlling first and second data drivers which drive data lines of a display panel including a plurality of scan lines and the data lines, the display control method including:

generating a first horizontal blanking adjustment signal for setting a first horizontal blanking period based on a value set in a first horizontal blanking period setting register in which a period until the first horizontal blanking adjustment signal changes is set;

generating a second horizontal blanking adjustment signal for setting a second horizontal blanking period based on a value set in a second horizontal blanking period setting register in which a period until the second horizontal blanking adjustment signal changes is set;

outputting the first horizontal blanking adjustment signal and a first grayscale clock signal to the first data driver, the first grayscale clock signal having first to N-th (N is an integer larger than one) grayscale pulses within a predetermined period specified by the first horizontal blanking adjustment signal, and the first data driver driving the data lines by using a signal which has been pulse-width-modulated based on the first horizontal blanking adjustment signal and the first grayscale clock signal; and outputting the second horizontal blanking adjustment signal and a second grayscale clock signal to the second data driver, the second grayscale clock signal having first to N-th grayscale pulses within a predetermined period specified by the second horizontal blanking adjustment signal, and the second data driver driving the data lines by using a signal which has been pulse-width-modulated based on the second horizontal blanking adjustment signal and the second grayscale clock signal, wherein the first horizontal blanking period is a period having a pulse of a first latch pulse signal which specifies one horizontal scan period based on a start timing of one horizontal scan period, and wherein the second horizontal blanking period is a period having a pulse of a second latch pulse signal which specifies one horizontal scan period based on the start timing.

BRIEF DESCRIPTION OF THE SEVERAL VIEWS OF THE DRAWING

FIG. 20A shows an example of a truth table illustrative of an operation of an HCNT counter; FIG. 20B shows an example of a truth table illustrative of an operation of a VCNT counter; and FIG. 20C shows an example of a truth table illustrative of an operation of a decoder shown in FIG. 19.

FIG. 24A shows an example of a truth table illustrative of an operation of a DCLK mask generation circuit shown in FIG. 23; FIG. 24B shows an example of a truth table illustrative of an operation of an LP mask generation circuit shown in FIG. 23; and FIG. 24C shows an example of a truth table illustrative of an operation of a decoder shown in FIG. 23.

FIG. 27 shows an example of a truth table illustrative of an operation of a trigger generation circuit shown in FIG. 26.

FIG. 32A shows a truth table of an operation of a pulse width counter shown in FIG. 31; FIG. 32B shows a truth table of an operation of a grayscale counter shown in FIG. 31; and FIG. 32C shows a truth table of an operation of a decoder shown in FIG. 31.

DETAILED DESCRIPTION OF THE EMBODIMENT

Figure 1:
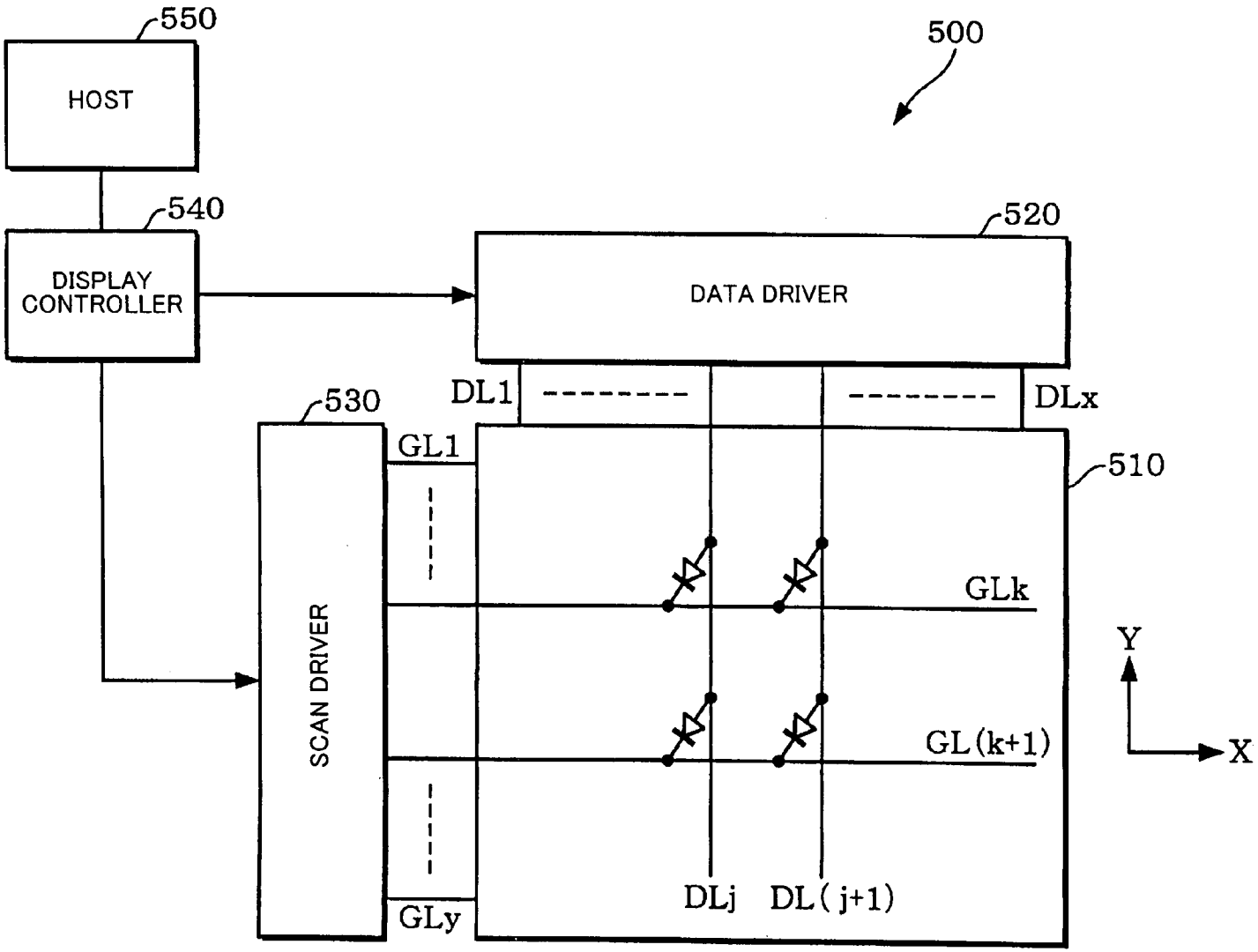
FIG. 1 is a block diagram of a configuration example of a display system in an embodiment of the present invention.

The present invention has been achieved in view of the above-described technical problem and may provide a display controller, a display system, and a display control method which control a plurality of drivers without causing the display quality to deteriorate.

One embodiment of the present invention provides a display controller for controlling first and second data drivers which drive data lines of a display panel including a plurality of scan lines and the data lines, the display controller including:

a blanking adjustment signal generation section which generates first and second horizontal blanking adjustment signals for respectively setting first and second horizontal blanking periods which have pulses of first and second latch pulse signals, respectively, each of the pulses specifying one horizontal scan period of one of the first and second horizontal blanking periods;

first and second horizontal blanking period setting registers in which periods from a start timing of one horizontal scan period until the first and second horizontal blanking adjustment signals change are respectively set; and a grayscale clock signal generation section which generates a first grayscale clock signal and a second grayscale clock signal, the first grayscale clock signal having first to N-th (N is an integer larger than one) grayscale pulses within a predetermined period specified by the first horizontal blanking adjustment signal, and the second grayscale clock signal having first to N-th grayscale pulses within a predetermined period specified by the second horizontal blanking adjustment signal, wherein the blanking adjustment signal generation section changes the first horizontal blanking adjustment signal when a period corresponding to a value set in the first horizontal blanking period setting register has elapsed from the start timing, and changes the second horizontal blanking adjustment signal when a period corresponding to a value set in the second horizontal blanking period setting register has elapsed from the start timing, and wherein the display controller outputs the first horizontal blanking adjustment signal and the first grayscale clock signal to the first data driver which drives the data lines by using a signal that has been pulse-width-modulated based on the first horizontal blanking adjustment signal and the first grayscale clock signal, and outputs the second horizontal blanking adjustment signal and the second grayscale clock signal to the second data driver which drives the data lines by using a signal that has been pulse-width-modulated based on the second horizontal blanking adjustment signal and the second grayscale clock signal.

In this embodiment, the display controller outputs the first and second horizontal blanking adjustment signals of which the change timings are separately controlled. The first and second data drivers supply signals having a pulse width corresponding to the grayscale data to the data lines by using the grayscale clock signals from the display controller within a horizontal display period specified by the horizontal blanking adjustment signal from the display controller. Therefore, since the horizontal display period (predetermined period specified by the first or second horizontal blanking adjustment signal) for performing grayscale control using PWM can be adjusted for each data driver, deterioration of the image quality caused by a difference in color tone or the like can be prevented even if the data lines of one display panel are driven using a plurality of data drivers.

This display controller may include a grayscale pulse setting register for setting an edge of each of the first to N-th grayscale pulses of the first grayscale clock signal, and the grayscale clock signal generation section may generate the first grayscale clock signal having the first to N-th grayscale pulses, of which an interval between a change timing of the first horizontal blanking adjustment signal and the edge of the first grayscale pulse and an interval between the edge of the (i−1)th ($2 \leqq i \leqq N$, i is an integer) grayscale pulse and the edge of the i-th grayscale pulse are set based on a value set in the grayscale pulse setting register, within a predetermined period which starts at the change timing of the first horizontal blanking adjustment signal and ends at a next change timing of the first horizontal blanking adjustment signal, and may generate the second grayscale clock signal having the first to N-th grayscale pulses, of which an interval between a change timing of the second horizontal blanking adjustment signal and the edge of the first grayscale pulse and an interval between the edge of the (i−1)th grayscale pulse and the edge of the i-th grayscale pulse are set based on a value set in the grayscale pulse setting register, within a predetermined period which starts at the change timing of the second horizontal blanking adjustment signal and ends at a next change timing of the second horizontal blanking adjustment signal.

According to this embodiment, since the grayscale clock signal of which the interval between the grayscale pulses can be set is generated, the pulse width can be caused to differ using PWM even if the value of the grayscale data is the same. This enables a desired grayscale representation to be implemented by performing fine gamma correction of the display panel. In particular, since the manufacturing technology of the organic EL panel is immature and not uniformed differing from the liquid crystal panel, it is particularly effective that fine gamma correction can be implemented.

This display controller may include an offset period setting register in which a phase difference between the first and second horizontal blanking adjustment signals is set, and the blanking adjustment signal generation section may generate the second horizontal blanking adjustment signal which changes earlier than the first horizontal blanking adjustment signal by a period corresponding to the phase difference set in the offset period setting register.

In this embodiment, since the phase difference is provided between the change timings of the horizontal blanking adjustment signals, deterioration of the image quality can be prevented by preventing a decrease in power supply voltage of the data drivers due to peak current which occurs when the horizontal blanking adjustment signals change at the same time. In a display panel having a high response speed such as an organic EL panel, the image quality is affected by only a small amount of fluctuation of power supply voltage. Therefore, it is effective to prevent a decrease in power supply voltage.

This display controller may include first and second vertical blanking period setting registers in which periods from the start timing of one horizontal scan period until change timing of first and second vertical blanking adjustment signals are set, respectively, the first and second vertical blanking adjustment signals being used for respectively setting first and second vertical blanking periods which have the pulses of the first and second latch pulse signals, respectively, the blanking adjustment signal generation section may change the first vertical blanking adjustment signal when a period corresponding to a value set in the first vertical blanking period setting register has elapsed from the start timing, and may change the second vertical blanking adjustment signal when a period corresponding to a value set in the second vertical blanking period setting register has elapsed from the start timing, and the display controller may output the first and second vertical blanking adjustment signals respectively to first and second scan drivers which drive the scan lines of the display panel including display elements which are discharged based on the first and second horizontal blanking adjustment signals and the first and second vertical blanking adjustment signals.

According to this embodiment, since the change timings of the first and second vertical blanking adjustment signals can be separately controlled, a flicker which may occur depending on the type and manufacturing difference of the display panel driven by the first and second scan drivers can be prevented, or luminance can be adjusted.

Another embodiment of the present invention provides a display system including:

a display panel which includes:

a plurality of scan lines;

a plurality of data lines; and a plurality of electroluminescent elements, each of the electroluminescent elements being specified by one of the scan lines and one of the data lines;

a scan driver which scans the scan lines;

first and second data drivers which drive the data lines; and the above display controller, wherein the display controller outputs the first horizontal blanking adjustment signal and the first grayscale clock signal to the first data driver, and outputs the second horizontal blanking adjustment signal and the second grayscale clock signal to the second data driver.

According to this embodiment, a display system which can cause the display region of the display panel in which the data lines are driven by the first data driver and the display region of the display panel in which the data lines are driven by the second data driver to exhibit the same image quality, even if the horizontal display period differs, can be provided.

A further embodiment of the present invention provides a display system including a display panel which includes:

a plurality of scan lines;

a plurality of data lines; and a plurality of electroluminescent elements, each of the electroluminescent elements being specified by one of the scan lines and one of the data lines;

first and second scan driver which scans the scan lines;

first and second data drivers which drive the data lines; and the above display controller, wherein the display controller outputs the first and second horizontal blanking adjustment signals respectively to the first and second data drivers, and outputs the first and second vertical blanking adjustment signals respectively to the first and second scan drivers, and wherein the electroluminescent elements are discharged based on the first and second horizontal blanking adjustment signals and the first and- second vertical blanking adjustment signals.

A still further embodiment of the present invention provides a display control method for controlling first and second data drivers which drive data lines of a display panel including a plurality of scan lines and the data lines, the display control method including:

generating a first horizontal blanking adjustment signal for setting a first horizontal blanking period based on a value set in a first horizontal blanking period setting register in which a period until the first horizontal blanking adjustment signal changes is set;

generating a second horizontal blanking adjustment signal for setting a second horizontal blanking period based on a value set in a second horizontal blanking period setting register in which a period until the second horizontal blanking adjustment signal changes is set;

outputting the first horizontal blanking adjustment signal and a first grayscale clock signal to the first data driver, the first grayscale clock signal having first to N-th (N is an integer larger than one) grayscale pulses within a predetermined period specified by the first horizontal blanking adjustment signal, and the first data driver driving the data lines by using a signal which has been pulse-width-modulated based on the first horizontal blanking adjustment signal and the first grayscale clock signal; and outputting the second horizontal blanking adjustment signal and a second grayscale clock signal to the second data driver, the second grayscale clock signal having first to N-th grayscale pulses within a predetermined period specified by the second horizontal blanking adjustment signal, and the second data driver driving the data lines by using a signal which has been pulse-width-modulated based on the second horizontal blanking adjustment signal and the second grayscale clock signal, wherein the first horizontal blanking period is a period having a pulse of a first latch pulse signal which specifies one horizontal scan period based on a start timing of one horizontal scan period, and wherein the second horizontal blanking period is a period having a pulse of a second latch pulse signal which specifies one horizontal scan period based on the start timing.

This display control method may include, based on a value set in an offset period setting register in which a phase difference between the first and second horizontal blanking adjustment signals is set, generating the second horizontal blanking adjustment signal which changes earlier than the first horizontal blanking adjustment signal by a period corresponding to the phase difference set in the offset period setting register.

This display control method may include:

generating the first grayscale clock signal having the first to N-th grayscale pulses, of which an interval between a change timing of the first horizontal blanking adjustment signal and an edge of the first grayscale pulse and an interval between an edge of the (i−1)th ($2 \leqq i \leqq N$, i is an integer) grayscale pulse and an edge of the i-th grayscale pulse are set based on a value set in the grayscale pulse setting register, within a predetermined period which starts at the change timing of the first horizontal blanking adjustment signal and ends at a next change timing of the first horizontal blanking adjustment signal; and generating the second grayscale clock signal having the first to N-th grayscale pulses, of which an interval between a change timing of the second horizontal blanking adjustment signal and an edge of the first grayscale pulse and an interval between an edge of the (i−1)th grayscale pulse and an edge of the i-th grayscale pulse are set based on a value set in the grayscale pulse setting register, within a predetermined period which starts at the change timing of the second horizontal blanking adjustment signal and ends at a next change timing of the second horizontal blanking adjustment signal.

The embodiments of the present invention are described below in detail with reference to the drawings. Note that the embodiments described hereunder do not in any way limit the scope of the invention defined by the claims laid out herein. Note also that not all of the elements of these embodiments should be taken as essential requirements to the means of the present invention.

1. Display System

FIG. 1 is a block diagram of a configuration example of a display system.

A display system 500 includes an organic EL panel (display panel in a broad sense) 510, a data driver 520, a scan driver 530, and a display controller 540. The display system 500 does not necessarily include all of these circuit blocks.

The display system 500 may have a configuration in which some of the circuit blocks are omitted. The display system 500 may be configured to include a host 550.

The organic EL panel 510 is a simple matrix type. FIG. 1 shows an electrical configuration of the organic EL panel 510. Specifically, the organic EL panel 510 includes a plurality of scan lines (cathodes in a narrow sense), a plurality of data lines (anodes in a narrow sense), and a plurality of organic EL elements (display elements in a broad sense), each of the organic EL elements being connected with one of the scan lines and one of the data lines.

In more detail, the organic EL panel is formed on a glass substrate. A plurality of data lines DL1 to DLx (x is an integer larger than one), arranged in a direction X shown in FIG. 1 and extending in a direction Y, are formed on the glass substrate. A plurality of scan lines GL1 to GLy (y is an integer larger than one), arranged in the direction Y shown in FIG. 1 and extending in the direction X, are formed on the glass substrate so that the scan lines intersect the data lines. In the case where one pixel is formed by three color components consisting of an R component, a G component, and a B component, a plurality of sets of data lines, each of the sets consisting of an R component data line, a G component data line, and a B component data line, are arranged in the organic EL panel 510.

An organic EL element is formed at a position corresponding to the intersecting point of the data line DLj ($1 \leqq j \leqq x$, j is an integer) and the scan line GLk ($1 \leqq k \leqq y$, k is an integer).

Figure 2:
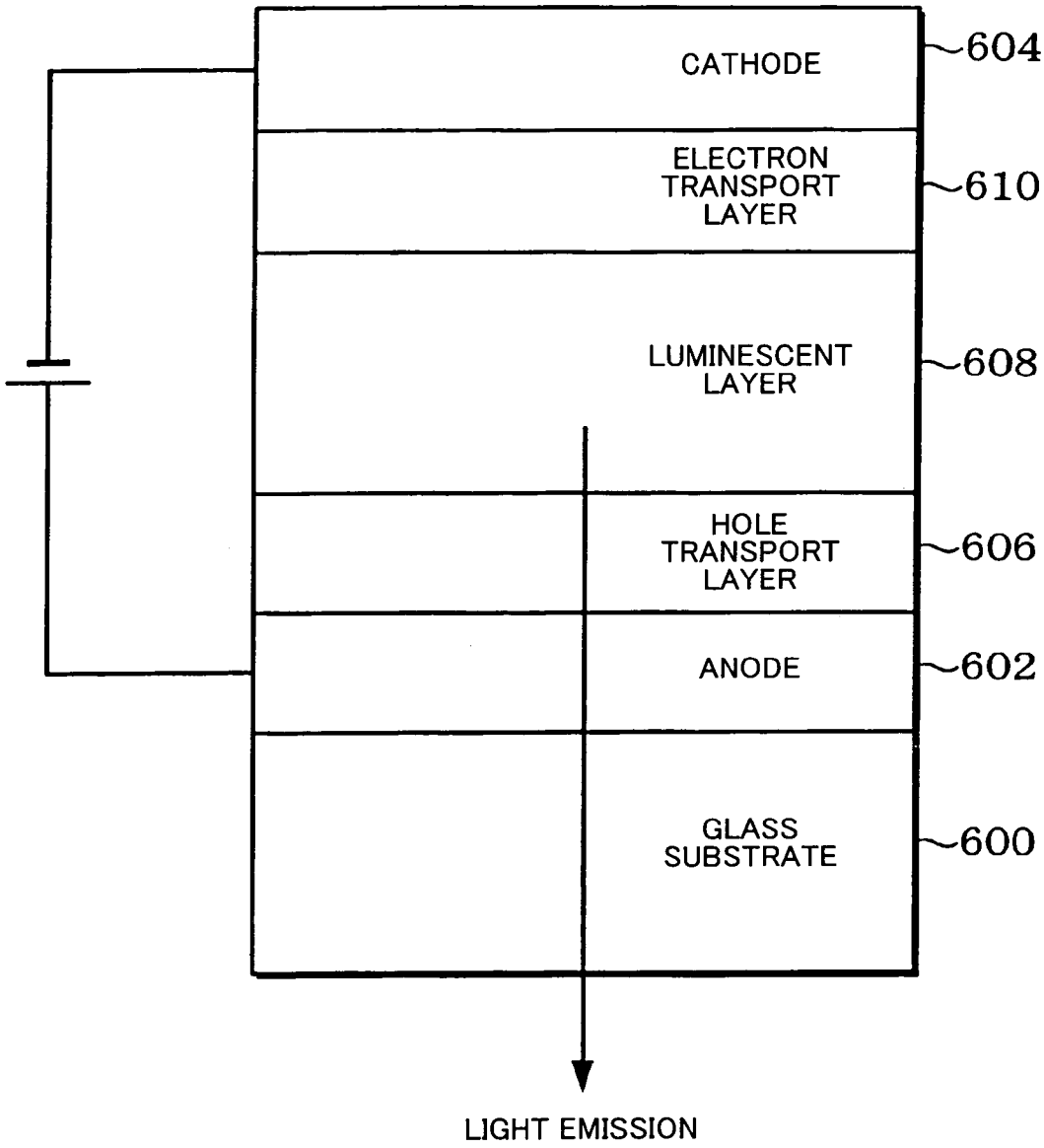
FIG. 2 is illustrative of a structure of an organic EL element.

FIG. 2 is illustrative of the structure of the organic EL element.

In the organic EL element, a transparent electrode (indium thin oxide (ITO), for example) which functions as an anode 602 provided as the data line is formed on a glass substrate 600. A cathode 604 provided as the scan line is formed above the anode 602. An organic layer including a luminescent layer and the like is formed between the anode 602 and the cathode 604.

The organic layer includes a hole transport layer 606 formed on the upper surface of the anode 602, a luminescent layer 608 formed on the upper surface of the hole transport layer 606, and an electron transport layer 610 formed between the luminescent layer 608 and the cathode 604.

A hole from the anode 602 and an electron from the cathode 604 are recombined in the luminescent layer 608 by applying a potential difference between the data line and the scan line, specifically, by applying a potential difference between the anode 602 and the cathode 604. The molecules of the luminescent layer 608 are excited by the energy generated, and the energy released when the molecules return to the ground state becomes light. The light passes through the anode 602 formed of a transparent electrode and the glass substrate 600.

In FIG. 1, the data driver 520 drives the data line based on grayscale data (display data in a broad sense). The data driver 520 generates a PWM signal having a pulse width corresponding to the grayscale data, and drives the data line based on the PWM signal.

The scan driver 530 sequentially selects the scan line. As a result, current flows through the organic EL element connected with the data line which intersects the selected scan line, whereby light is emitted.

The display controller 540 controls the data driver 520 and the scan driver 530 according to the content set by the host 550 such as a central processing unit (CPU). In more detail, the display controller 540 sets an operation mode of the data driver 520, and supplies a latch pulse signal (horizontal synchronization signal) LP, a grayscale clock signal GCLK (R component grayscale signal GCLKR, G component grayscale clock signal GCLKG, and B component grayscale clock signal GCLKB) for generating a PWM signal, a dot clock signal DCLK, a discharge signal DIS1 (horizontal blanking adjustment signal in a broad sense), and grayscale data D generated therein to the data driver 520, for example. A horizontal scan period is specified by the latch pulse signal LP. The display controller 540 sets an operation mode of the scan driver 530, and supplies a vertical synchronization signal YD, a latch pulse signal LP, and a discharge signal DIS2 (vertical blanking adjustment signal in a broad sense) generated therein to the scan driver 530, for example. A vertical scan period is specified by the vertical synchronization signal YD.

FIG. 1 shows the case of driving the organic EL panel 510 using one data driver 520 and one scan driver 530. However, the same description applies to the case of driving an organic EL panel 520 using a plurality of data drivers 520 and a plurality of scan drivers 530. In this case, the data drivers are cascade-connected, and the scan drivers are cascade-connected. The display controller 540 in this embodiment can separately supply the synchronization signal to each of the data drivers and each of the scan drivers. In more detail, the display controller 540 supplies at least the latch pulse signal LP, the grayscale clock signal GCLK, and the discharge signal DIS1 to each of the data drivers. The display controller 540 supplies at least the discharge signal DIS2 to each of the scan drivers.

Some or all of the data driver 520, the scan driver 530, and the display controller 540 may be formed on the organic EL panel 510.

1.1 Data Driver

Figure 3:
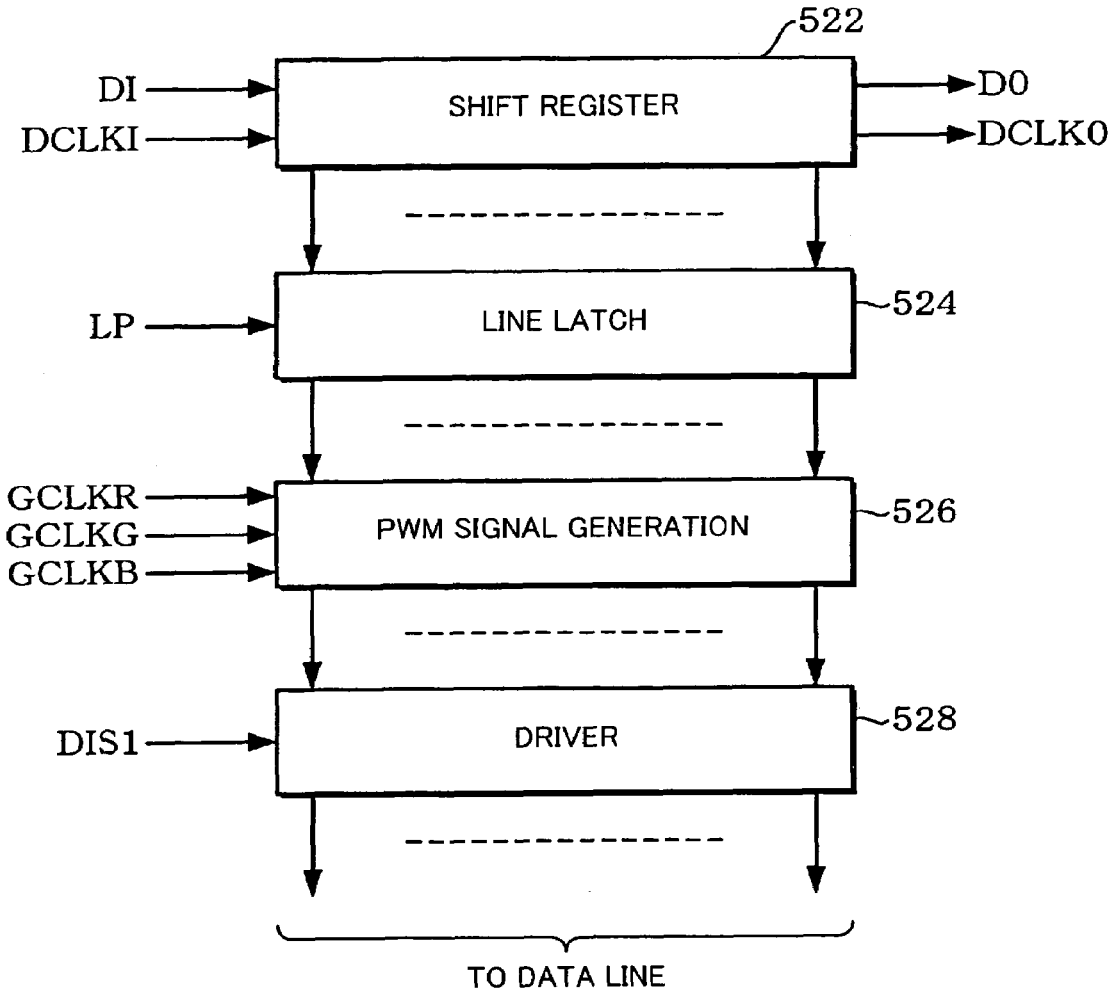
FIG. 3 is a block diagram of a configuration example of a data driver shown in FIG. 1.

FIG. 3 shows a configuration example of the data driver 520 shown in FIG. 1.

The data driver 520 includes a shift register 522, a line latch 524, a PWM signal generation circuit 526, and a driver circuit 528. The data driver 520 has a configuration which allows cascade connection by serially connecting the shift register 522 with a shift register of another data driver.

The shift register 522 includes a plurality of flip-flops, each of the flip-flops being provided corresponding to one of the data lines and being sequentially connected. A dot clock signal DCLKI from the display controller 540 is input to each of the flip-flops. R component grayscale data, G component grayscale data, B component grayscale data, R component grayscale data, . . . are sequentially input to the flip-flop in the first stage of the shift register 522 from the display controller 540 in four bit units in synchronization with the dot clock signal DCLKI, for example. The R component grayscale data is data for driving the R component data line. The G component grayscale data is data for driving the G component data line. The B component grayscale data is data for driving the B component data line. The shift register 522 stores the grayscale data in synchronization with the dot clock signal DCLKI while shifting the grayscale data.

The shift register 522 outputs the dot clock signal DCLKI from the display controller 540 as a dot clock signal DCLKO. The shift register 522 outputs the grayscale data output from the flip-flop in the final stage as grayscale data DO. The dot clock signal DCLKO and the grayscale data DO are input to a shift register of a data driver which is cascade-connected in the subsequent stage. The shift register of the data driver in the subsequent stage stores the grayscale data in the same manner as the shift register 522.

The line latch 524 latches the grayscale data in one horizontal scan unit stored by the shift register 522 in synchronization with the latch pulse signal LP supplied from the display controller 540.

The PWM signal generation circuit 526 generates the PWM signal for driving the data line. In more detail, the PWM signal generation circuit 526 generates the PWM signal of which the change point is specified by the grayscale clock signal (grayscale pulse of the grayscale clock signal in more detail) based on the grayscale data corresponding to the data line. The PWM signal has a pulse width in the number of pulses of the grayscale clock signal GCLK corresponding to the grayscale data. The PWM signal generation circuit 526 generates a PWM signal PWMR for the R component data line using the R component grayscale clock signal GCLKR and the R component grayscale data stored corresponding to the data line. The PWM signal generation circuit 526 generates a PWM signal PWMG for the G component data line using the G component grayscale clock signal GCLKG and the G component grayscale data stored corresponding to the data line. The PWM signal generation circuit 526 generates a PWM signal PWMB for the B component data line using the B component grayscale clock signal GCLKB and the B component grayscale data stored corresponding to the data line.

The driver circuit 528 drives the data line based on the PWM signal generated by the PWM signal generation circuit 526. The discharge signal DIS1 from the display controller 540 is input to the driver circuit 528. The horizontal display period within the horizontal scan period specified by the latch pulse signal LP is specified by the discharge signal DIS1. The horizontal display period is a period which starts at the falling edge of the discharge signal DIS1 and ends at the next rising edge of the discharge signal DIS1. A pulse of the latch pulse signal LP occurs within a period in which the discharge signal DIS1 is set at the H level.

The driver circuit 528 connects the data line with a ground potential when the discharge signal DIS1 is set at the H level, and supplies a predetermined current to the data line for a period corresponding to the pulse width of the PWM signal when the discharge signal DIS1 is set at the L level.

The data driver 520 prevents the data line from being driven by the grayscale data in the middle of rewriting by latching the grayscale data in the next horizontal scan period in the line latch 524 when the discharge signal DIS1 is set at the H level.

1.2 Scan Driver

Figure 4:
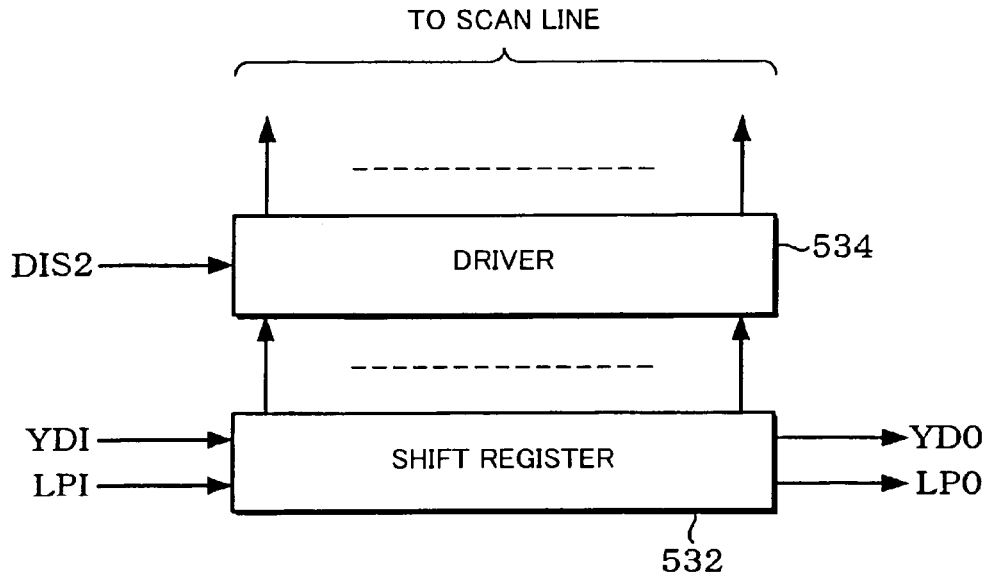
FIG. 4 is a block diagram of a configuration example of a scan driver shown in FIG. 1.

FIG. 4 shows a configuration example of the scan driver 530 shown in FIG. 1.

The scan driver 530 includes a shift register 532 and a driver circuit 534. The scan driver 530 has a configuration which allows cascade connection by serially connecting the shift register 532 with a shift register of another scan driver.

The shift register 532 includes a plurality of flip-flops, each of the flip-flops being provided corresponding to one of the scan lines and being sequentially connected. A latch pulse signal LPI from the display controller 540 is input to each of the flip-flops. A vertical synchronization signal YDI from the display controller 540 is input to the flip-flop in the first stage of the shift register 532. The shift register 532 shifts a pulse of the vertical synchronization signal YDI in synchronization with the latch pulse signal LPI.

The shift register 532 outputs the latch pulse signal LPI from the display controller 540 as a latch pulse signal LPO. The shift register 532 outputs the vertical synchronization signal output from the flip-flop in the final stage as a vertical synchronization signal YDO. The latch pulse signal LPO and the vertical synchronization signal YDO are input to a shift register of a scan driver which is cascade-connected in the subsequent stage. The shift register of the scan driver in the subsequent stage shifts the pulse of the vertical synchronization signal YDO in the same manner as the shift register 532.

The driver circuit 534 sequentially outputs a select pulse to the scan line based on the output from the flip-flop of the shift register 532. The discharge signal DIS2 from the display controller 540 is input to the driver circuit 534. The driver circuit 534 connects all the scan lines with the ground potential when the discharge signal DIS2 is set at the H level, and connects only the selected scan line with the ground potential and connects the remaining scan lines with a predetermined potential when the discharge signal DIS2 is set at the L level.

1.3 Discharge Operation

Figure 5:
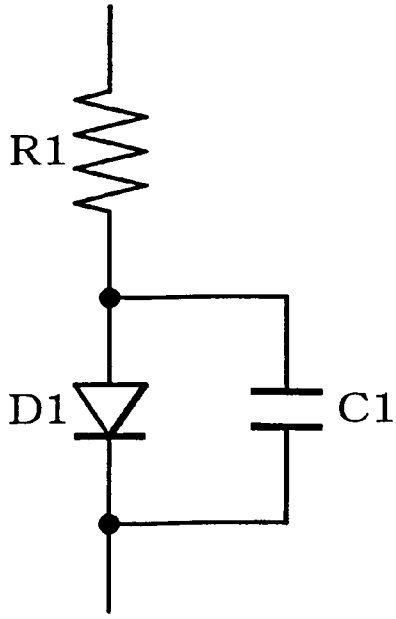
FIG. 5 shows an example of an electrical equivalent circuit diagram of an organic EL element.

FIG. 5 shows an example of an electrical equivalent circuit diagram of the organic EL element.

The organic EL element is considered to be equivalent to a configuration in which a resistance component R1 and a diode D1 are connected in series and which includes a parasitic capacitor C1 connected in parallel with the diode D1. The parasitic capacitor C1 is considered to be a capacitance component corresponding to a depletion layer formed at the junction when a potential difference is applied between the anode 602 and the cathode 604. Therefore, the organic EL element is considered to be a capacitive load.

Therefore, in the display system 500, the effect of the preceding horizontal scan period can be eliminated by performing a discharge operation of the organic EL elements of the organic EL panel 510 using the discharge signals DIS1 and DIS2.

Figure 6:
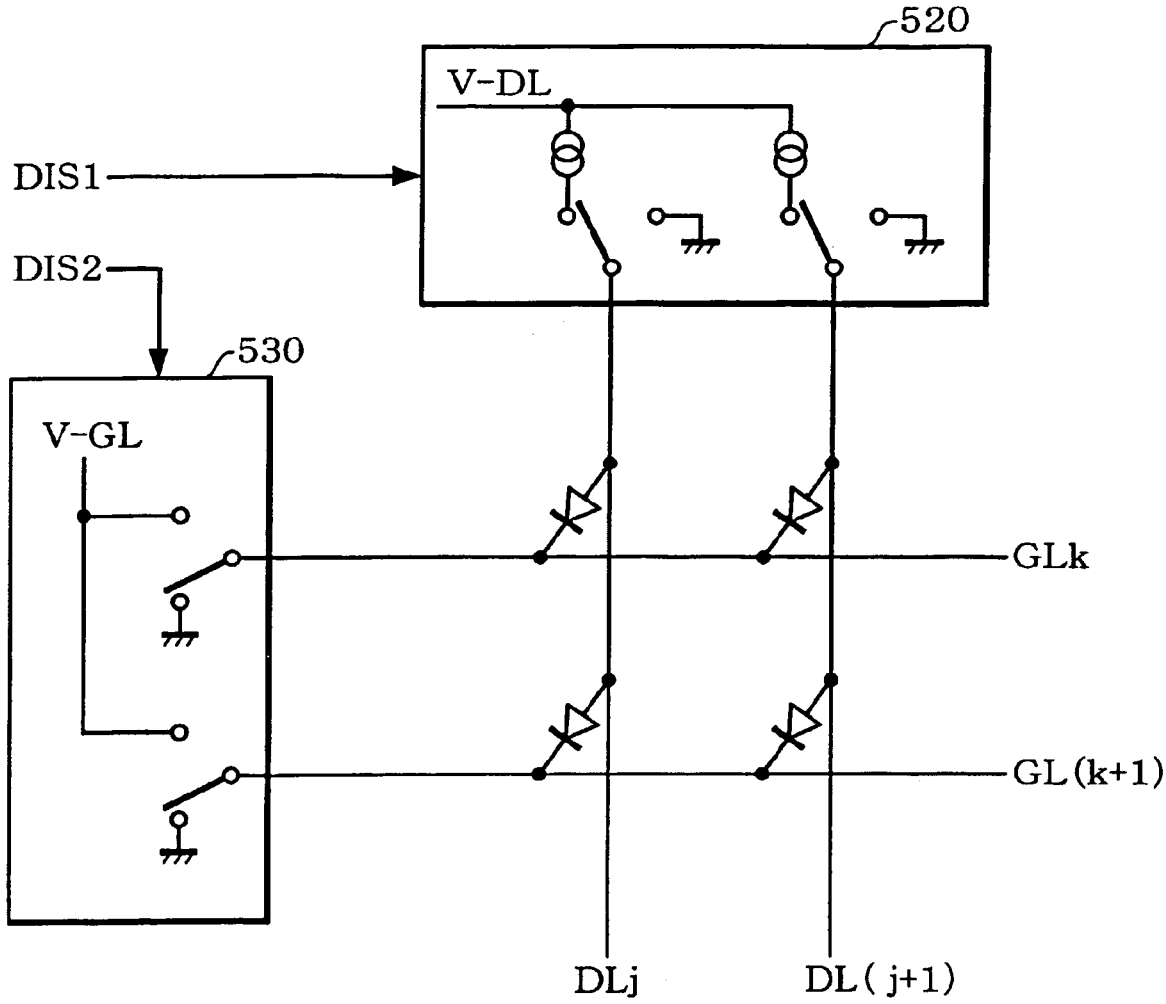
FIG. 6 is illustrative of a discharge operation.

FIG. 6 is illustrative of the discharge operation. In FIG. 6, sections the same as the sections of the display system shown in FIG. 1 are indicated by the same symbols.

The data driver 520 supplies a predetermined current to the data line for a period of the pulse width corresponding to the PWM signal when the discharge signal DIS1 is set at the L level. The data driver 520 connects all the data lines with the ground potential when the discharge signal DIS1 is set at the H level.

When the discharge signal DIS2 is set at the L level, the scan driver 530 connects only the selected scan line with the ground potential and connects the remaining scan lines with a potential V-GL. The scan driver 530 connects all the scan lines with the ground potential when the discharge signal DIS2 is set at the H level.

Therefore, current flows through the organic EL elements connected with the selected scan line when the discharge signals DIS1 and DIS2 are set at the L level. The potentials on opposite ends of the organic EL elements become equal when the discharge signals DIS1 and DIS2 are set at the H level, whereby the organic EL element can be discharged.

A flicker which may occur depending on the type and manufacturing variation of the organic EL panel can be prevented or luminance can be adjusted by adjusting the length of the horizontal display period within the horizontal scan period. The blanking period can be adjusted by using the discharge signals DIS1 and DIS2. Therefore, the discharge signal DIS1 may be called a horizontal blanking adjustment signal, and the discharge signal DIS2 may be called a vertical blanking adjustment signal.

2. Display Controller 2.1. Cascade Connection

The display controller 540 in this embodiment can output a plurality of horizontal blanking adjustment signals. A horizontal display period in which grayscale control using PWM is performed is specified by the horizontal blanking adjustment signal. The display controller 540 can separately set the change timings of the horizontal blanking adjustment signals. The display controller 540 can provide a phase difference between the change timings of the horizontal blanking adjustment signals, and can adjust the phase difference. The display controller 540 can output a plurality of grayscale clock signals. The grayscale clock signal has a plurality of grayscale pulses within a predetermined period (horizontal display period) specified by the horizontal blanking adjustment signal.

The horizontal blanking adjustment signals and the grayscale clock signals are supplied to each of a plurality of cascade-connected data drivers. The data driver supplies a PWM signal having a pulse width corresponding to the grayscale data to the data line using the grayscale clock signal from the display controller 540 within the horizontal display period specified by the horizontal blanking adjustment signal from the display controller 540. Therefore, since the horizontal display period for performing grayscale control using PWM can be adjusted for each data driver, deterioration of the image quality caused by a difference in color tone or the like can be prevented even if the data lines of one organic EL panel are driven using a plurality of data drivers. Moreover, since the phase difference is provided between the change timings of the horizontal blanking adjustment signals, deterioration of the image quality can be prevented by preventing a decrease in power supply voltage of the data drivers due to peak current which occurs when the horizontal blanking adjustment signals are changed at the same time. Since the organic EL panel has a high response speed, the image quality is affected by only a small amount of fluctuation of power supply voltage. Therefore, it is effective to prevent a decrease in power supply voltage.

The following description illustrates the case where cascade-connected drivers are connected in two stages. However, the same description also applies to the case where cascade-connected drivers are connected in three or more stages. The present invention is not limited to the number of stages.

Figure 7:
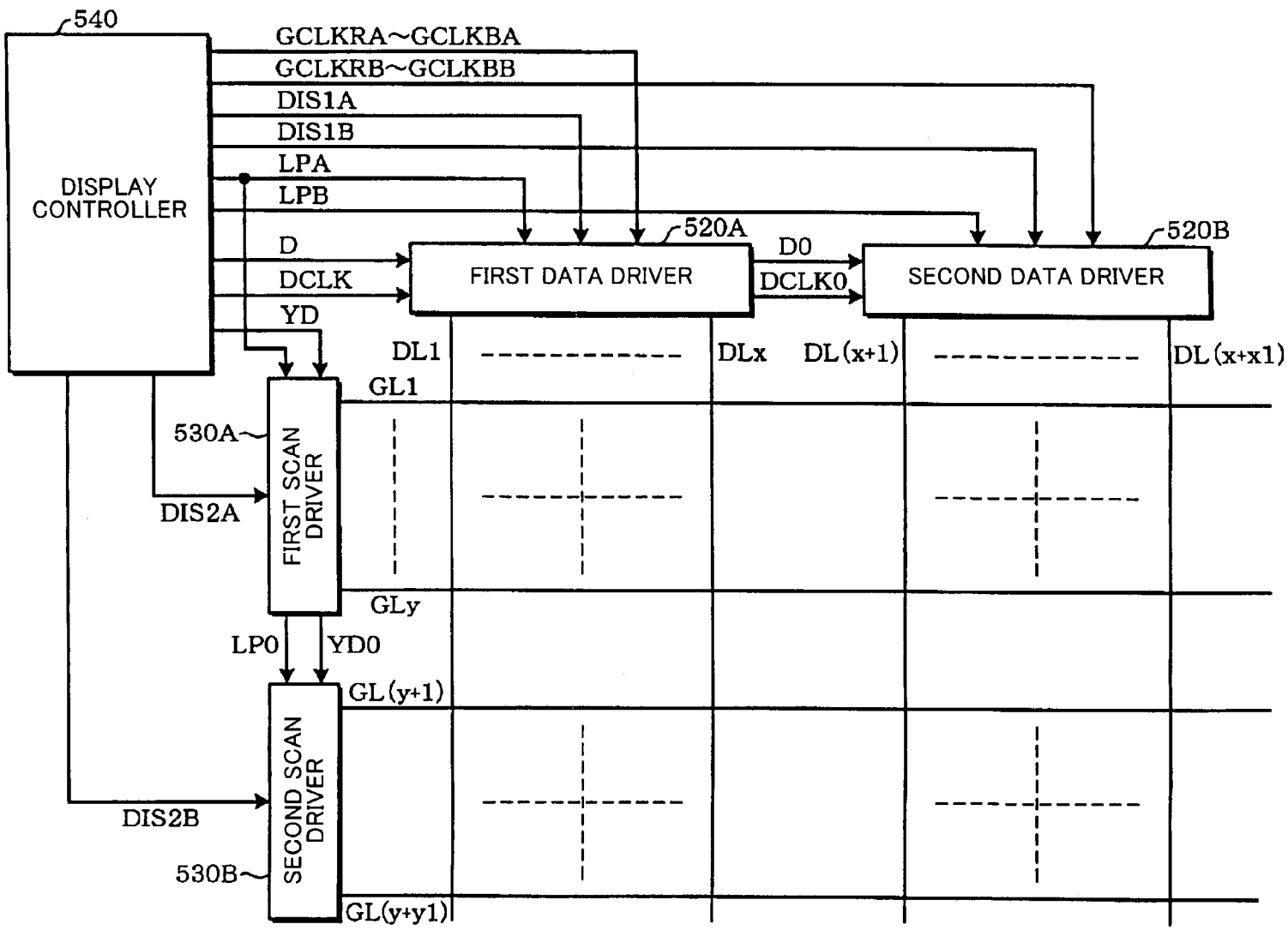
FIG. 7 shows an example of the connection relationship between a display controller and two cascade-connected drivers.

FIG. 7 shows an example of the connection relationship between the display controller and two cascade-connected drivers. In FIG. 7, sections the same as the sections shown in FIG. 1 are indicated by the same symbols. Description of these sections is appropriately omitted. FIG. 7 shows the case where the display controller 540 is connected with two cascade-connected data drivers and two cascade-connected scan drivers.

First and second data drivers 520A and 520B shown in FIG. 7 have a configuration the same as the configuration of the data driver 520 shown in FIG. 3. However, the number of data lines which can be driven by the first data driver 520A is x, and the number of data lines which can be driven by the second data driver 520B is x1 (x1<x, for example, x 1 is a natural number). First and second scan drivers 530A and 530B shown in FIG. 7 have a configuration the same as the configuration of the scan driver 530 shown in FIG. 4. In FIG. 7, the number of scan lines scanned by the first scan driver 530A is y, and the number of scan lines scanned by the second scan driver 530B is y1 (y1 is a natural number; y1 may be equal to y).

The display controller 540 supplies the grayscale data D and the dot clock signal DCLK to a shift register (not shown) of the first data driver 520A. The first data driver 520A shifts the grayscale data D in synchronization with the dot clock signal DCLK. Grayscale data DO which is shifted and output from the first data driver 520A is supplied to a shift register (not shown) of the second data driver 520B. A dot clock signal DCLKO output from the first data driver 520A is supplied to the shift register (not shown) of the second data driver 520B.

The display controller 540 outputs a first horizontal blanking adjustment signal (discharge signal DIS1A) and first grayscale clock signals GCLKRA to GCLKBA to the first data driver 520A. The display controller 540 outputs a second horizontal blanking adjustment signal (discharge signal DIS1B) and second grayscale clock signals GCLKRB to GCLKBB to the second data driver 520B. The display driver 540 includes first and second horizontal blanking period setting registers (not shown in FIG. 7), and can generate the first and second horizontal blanking adjustment signals which change after a period corresponding to a value set in the horizontal blanking period setting register has elapsed. This enables adjustment of the horizontal display periods of the first and second data drivers 520A and 520B to which the first and second horizontal blanking adjustment signals are respectively supplied.

The display driver 540 includes an offset period setting register (not shown in FIG. 7) in which the phase difference between the first and second horizontal blanking adjustment signals is set, and can displace the change timings of the first and second horizontal blanking adjustment signals from each other for the phase difference corresponding to the value set in the offset period setting register. This prevents the first and second horizontal blanking adjustment signals from changing at the same time, whereby the peak current generation timings can be displaced from each other.

The display controller 540 outputs a first latch pulse signal LPA to the first data driver 520A, and outputs a second latch pulse signal LPB to the second data driver 520B. The display controller 540 includes the offset period setting register (not shown in FIG. 7) in which the phase difference between the first and second latch pulse signals LPA and LPB is set, and can displace the change timings of the first and second latch pulse signals LPA and LPB from each other for the phase difference corresponding to the value set in the offset period setting register. As a result, since the peak current generation timings, which occur at the same time when the latch timings occur at the same time, can be displaced from each other, fine timing adjustment can be implemented by preventing a decrease in power supply voltage of the data drivers without changing the image quality in the display region driven by the data lines DL1 to DLx and the display region driven by the data lines DL(x+1) to DL(2x).

The display controller 540 can output a plurality of (horizontal) discharge signals DIS1 of which the change timings are displaced from each other. In FIG. 7, the display controller 540 outputs a discharge signal DIS1A (first horizontal blanking adjustment signal) to the first data driver 520A, and outputs a discharge signal DIS1B (second horizontal blanking adjustment signal) to the second data driver 520B. The display controller 540 can displace the change timings of the discharge signals DIS1A and DIS1B from each other for the phase difference corresponding to the value set in the offset period setting register. As a result, the peak current generation timings, which occur at the same time when the change timings of the discharge signals DIS1A and DIS1B occur at the same time, can be easily displaced from each other. Moreover, fine timing adjustment can be implemented without changing the image quality in the display region driven by the data lines DL1 to DLx and the display region driven by the data lines DL(x+1) to DL(2x).

The display controller 540 can output a plurality of grayscale clock signals, the change timings of the grayscale clock signals having each RGB color component being displaced from each other. In FIG. 7, the display controller 540 outputs first grayscale clock signals GCLKRA to GCLKBA to the first data driver 520A, and outputs second grayscale clock signals GCLKRB to GCLKBB to the second data driver 520B. The display controller 540 can displace the change timings of the first and second grayscale clock signals of each color component (GCLKRA and GCLKRB, GCLKGA and GCLKGB, GCLKBA and GCLKBB, for example) from each other for the phase difference corresponding to the value set in the offset period setting register. As a result, the peak current generation timings, which occur at the same time when the change timings of the grayscale clock signals occur at the same time, can be easily displaced from each other. Moreover, fine timing adjustment can be implemented without changing the image quality in the display region driven by the data lines DL1 to DLx and the display region driven by the data lines DL(x+1) to DL(x+x1).

The display controller 540 supplies the vertical synchronization signal YD and the first latch pulse signal LPA to a shift register (not shown) of the first scan driver 530A. The first scan driver 530A shifts a pulse of the vertical synchronization signal YD in synchronization with the first latch pulse signal LPA. The pulse YDO of the vertical synchronization signal YD which is shifted and output from the first scan driver 530A is supplied to a shift register (not shown) of the second scan driver 530B. The latch pulse signal LPO (first latch pulse signal LPA) output from the first scan driver 530A is supplied to the shift register (not shown) of the second scan driver 530B.

The display controller 540 may output a plurality of (vertical) discharge signals DIS2 of which the change timings are displaced from each other. In FIG. 7, the display controller 540 outputs a discharge signal DIS2A (first vertical blanking adjustment signal) to the first scan driver 530A, and outputs a discharge signal DIS2B (second vertical blanking adjustment signal) to the second scan driver 530B. The display controller 540 can displace the change timings of the discharge signals DIS2A and DIS2B from each other for the phase difference corresponding to the value set in the offset period setting register. As a result, the peak current generation timings, which occur at the same time when the change timings of the discharge signals DIS2A and DIS2B occur at the same time, can be easily displaced from each other. Moreover, fine timing adjustment can be implemented without changing the image quality in the display region scanned by the scan lines GL1 to GLy and the display region scanned by the scan lines GL(y+1) to GL(y +y1).

The electroluminescent elements of the organic EL panel 510 are discharged based on the first and second horizontal blanking adjustment signals and the first and second vertical blanking adjustment signals.

In FIG. 7, the scan drivers are cascade-connected. However, the scan lines may be scanned using one scan driver.

2.2 Outline of Configuration

Figure 8:
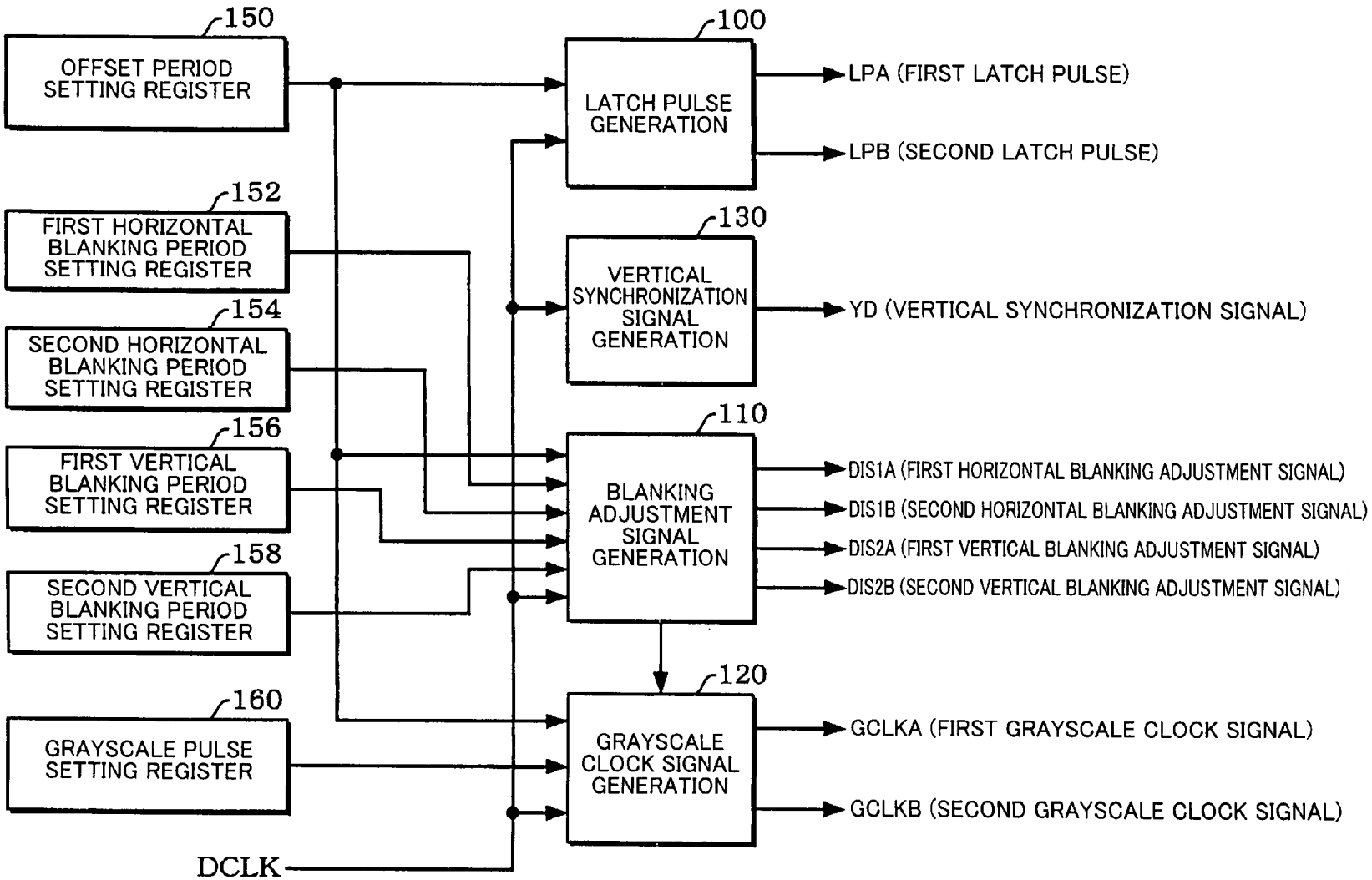
FIG. 8 is a block diagram showing an outline of a configuration of a display controller in this embodiment.

FIG. 8 shows an outline of a configuration of the display controller 540 in this embodiment. A part of the configuration shown in FIG. 8 may be omitted.

The display controller 540 includes a blanking adjustment signal generation section 110, first and second horizontal blanking period setting registers 152 and 154, and a grayscale clock signal generation section 120.

The blanking adjustment signal generation section 110 generates the first and second horizontal blanking adjustment signals (discharge signals DIS1A and DIS1B) for respectively setting the first and second horizontal blanking periods respectively having the pulses of the first and second latch pulse signals for specifying one horizontal scan period, respectively. A period (data corresponding to the period) from the start timing of one horizontal scan period until the first horizontal blanking adjustment signal changes is set in the first horizontal blanking period setting register 152. The start timing of one horizontal scan period may be the change timing (falling edge in more detail) of the first latch pulse signal LPA. A period (data corresponding to the period) from the start timing of one horizontal scan period until the second horizontal blanking adjustment signal changes is set in the second horizontal blanking period setting register 154. The start timing of one horizontal scan period may be the change timing (falling edge in more detail) of the second latch pulse signal LPB. The falling edges of the first and second latch pulse signals LPA and LPB may occur at the same time. In this case, the first and second data drivers 520A and 520B may store the grayscale data at the rising edges of the first and second latch pulse signals LPA and LPB, respectively.

The grayscale clock signal generation section 120 generates the first and second grayscale clock signals GCLKA and GCLKB, each of the grayscale clock signals having first to N-th (N is an integer larger than one) grayscale pulses within a predetermined period. In the case where each of the grayscale clock signals includes grayscale clock signals for each RGB color component, the grayscale clock signal generation section 120 may generate first and second grayscale clock signals GCLKRA to GCLKBA and GCLKRB to GCLKBB, each of the grayscale clock signals having first to N-th grayscale pulses within a predetermined period.

The blanking adjustment signal generation section 110 generates the first horizontal blanking adjustment signal (discharge signal DIS1A) which changes when the period corresponding to the value set in the first horizontal blanking period setting register 152 has elapsed from the start timing of one horizontal scan period (falling edge of the first latch pulse signal LPA). The blanking adjustment signal generation section 110 generates the second horizontal blanking adjustment signal (discharge signal DIS1B) which changes when the period corresponding to the value set in the second horizontal blanking period setting register 154 has elapsed from the start timing of one horizontal scan period (falling edge of the second latch pulse signal LPB).

The display controller 540 outputs the first horizontal blanking adjustment signal (discharge signal DIS1A) and the first grayscale clock signal GCLKA (GCLKRA to GCLKBA) to the first data driver 520A. The first data driver 520A drives the data lines DL1 to DLx using signals pulse-width-modulated based on the first horizontal blanking adjustment signal and the first grayscale clock signal. The display controller 540 outputs the second horizontal blanking adjustment signal (discharge signal DIS1B) and the second grayscale clock signal GCLKB (GCLKRB to GCLKBB) to the second data driver 520B. The second data driver 520B drives the data lines DL(x+1) to DL(x+x1) using signals pulse-width-modulated based on the second horizontal blanking adjustment signal and the second grayscale clock signal.

The display controller 540 may further include an offset period setting register 150. In this case, the blanking adjustment signal generation section 110 generates the second horizontal blanking adjustment signal which changes before the first horizontal blanking adjustment signal for a period of the phase difference corresponding to the value set in the offset period setting register 150.

The display controller 540 may include first and second vertical blanking period setting registers 156 and 158. A period from the start timing of one horizontal scan period until the change timing of a first vertical blanking adjustment signal (discharge signal DIS2A) for setting a first vertical blanking period that has the pulse of the first latch pulse signal LPA is set in the first vertical blanking period setting register 156. A period from the start timing of one horizontal scan period until the change timing of a second vertical blanking adjustment signal (discharge signal DIS2B) for setting a second vertical blanking period that has the pulse of the second latch pulse signal LPB is set in the second vertical blanking period setting register 158.

The blanking adjustment signal generation section 110 generates the first vertical blanking adjustment signal which changes when the period corresponding to the value set in the first vertical blanking period setting register 156 has elapsed from the start timing of one horizontal scan period. The blanking adjustment signal generation section 110 generates the second vertical blanking adjustment signal which changes when the period corresponding to the value set in the second vertical blanking period setting register 158 has elapsed from the start timing of one horizontal scan period.

The display controller 540 outputs the first and second vertical blanking adjustment signals respectively to the first and second scan drivers 530A and 530B. The first scan driver 530A scans the scan lines GL1 to GLy of the organic EL panel including the display elements which are discharged based on the first and second horizontal blanking adjustment signals and the first and second vertical blanking adjustment signals. The second scan driver 530B scans the scan lines GL(y+2) to GL(y +y1) of the organic EL panel including the display elements which are discharged based on the first and second horizontal blanking adjustment signals and the first and second vertical blanking adjustment signals.

The blanking adjustment signal generation section 110 may generate the second vertical blanking adjustment signal (discharge signal DIS2B) which changes before the first vertical blanking adjustment signal (discharge signal DIS2A) for a period of the phase difference corresponding to the value set in the offset period setting register 150.

The display controller 540 may further include a latch pulse signal generation section 100 and the offset period setting register 150. The latch pulse signal generation section 100 generates the first and second latch pulse signals LPA and LPB having pulses which specify one horizontal scan period. The latch pulse signal generation section 100 may generate the second latch pulse signal LPB which changes before the first latch pulse signal LPA for a period of the phase difference corresponding to the value set in the offset period setting register 150. The display controller 540 outputs the first and second latch pulse signals LPA and LPB respectively to the first and second data drivers 520A and 520B which store the grayscale data (display data in a broad sense) for one horizontal scan period based on the first and second latch pulse signals LPA and LPB.

Figure 9:
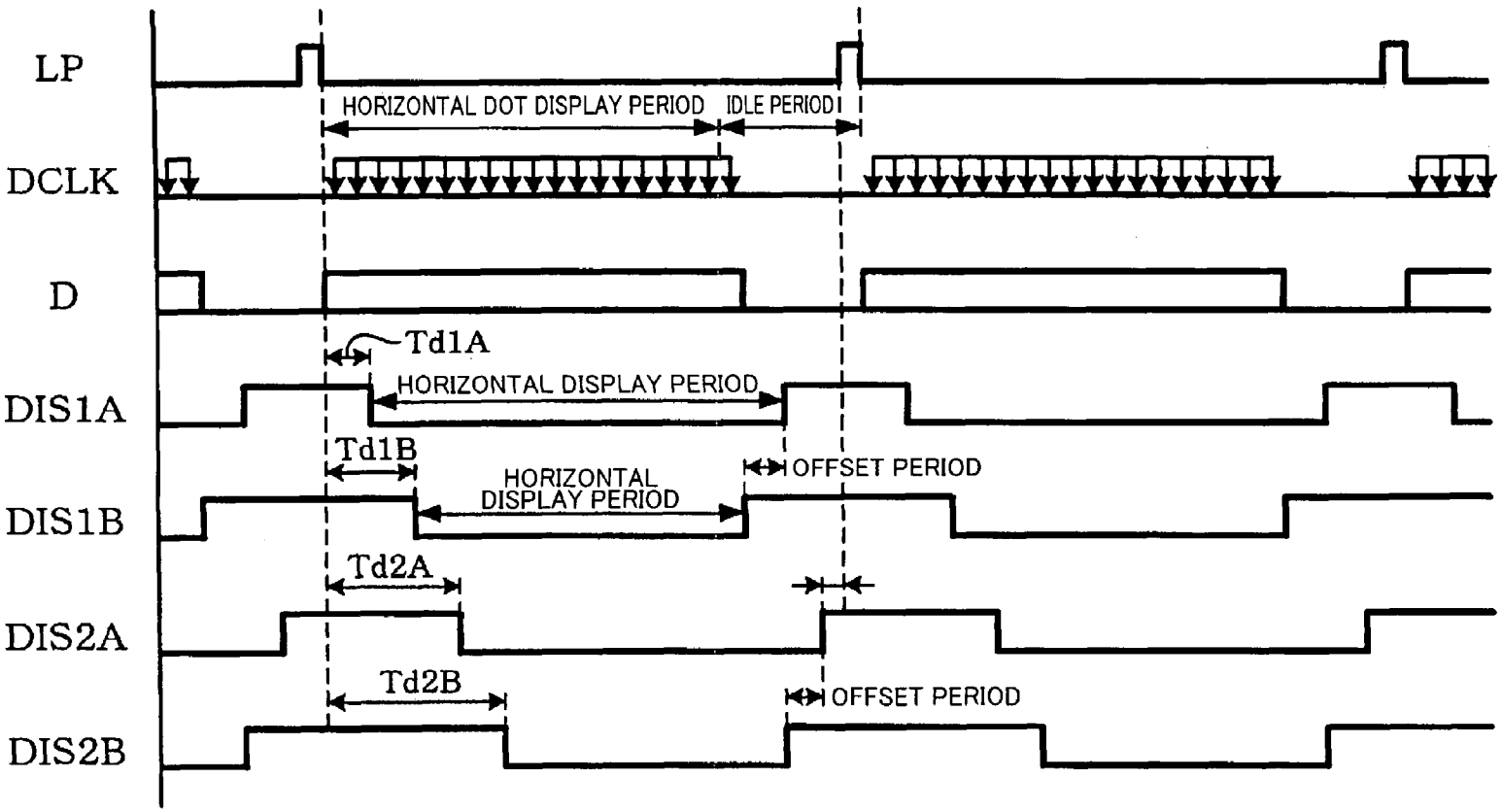
FIG. 9 is illustrative of first and second horizontal blanking period setting registers and first and second vertical blanking period setting registers.

FIG. 9 is illustrative of the first and second horizontal blanking period setting registers and the first and second vertical blanking period setting registers. FIG. 9 shows the latch pulse signal LP as the first and second latch pulse signals LPA and LPB having a common falling edge.

In this embodiment, the blanking adjustment signal is set at the H level for a period in the number of cycles of the dot clock signal DCLK corresponding to the value set in each of the first and second horizontal blanking period setting registers 152 and 154 and the first and second vertical blanking period setting registers 156 and 158. In FIG. 9, a value of the number of cycles corresponding to a period Td1A is set in the first horizontal blanking period setting register 152. A value of the number of cycles corresponding to a period Td1B is set in the second horizontal blanking period setting register 154. A value of the number of cycles corresponding to a period Td2A is set in the first vertical blanking period setting register 156. A value of the number of cycles corresponding to a period Td2B is set in the second vertical blanking period setting register 158.

A flicker which may occur depending on the type and manufacturing variation of the organic EL panel can be prevented or luminance can be adjusted by enabling the horizontal blanking period and the vertical blanking period to be set as described above. In particular, the horizontal display periods of the first and second data drivers 520A and 520B can be separately set.

Figure 10:
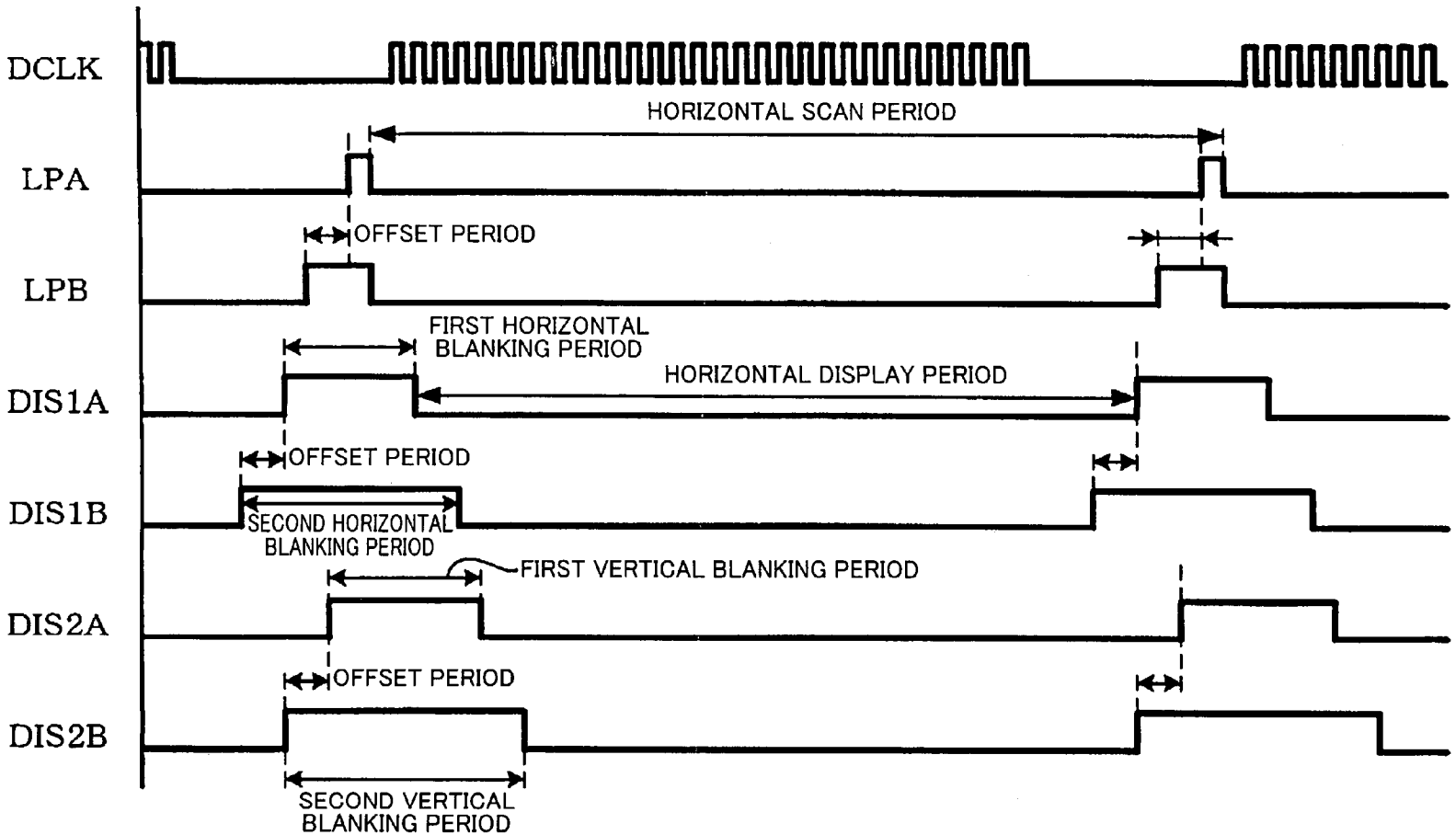
FIG. 10 is illustrative of a phase difference set in an offset period setting register.

FIG. 10 is illustrative of the phase difference (offset period) set in the offset period setting register 150.

In this embodiment, the offset period in the number of cycles of the dot clock signal DCLK corresponding to the value set in the offset period setting register 150 is set. The latch pulse signal generation section 100 generates the second latch pulse signal LPB which changes before the first latch pulse signal LPA for the offset period. Therefore, since a point near the end point of one horizontal scan period is used, the phase difference can be provided while eliminating the effect on display using PWM control, for example.

The blanking adjustment signal generation section 110 generates the second horizontal blanking adjustment signal (discharge signal DIS1B) which changes before the first horizontal blanking adjustment signal (discharge signal DIS1A) for the offset period. The blanking adjustment signal generation section 110 generates the second vertical blanking adjustment signal (discharge signal DIS2B) which changes before the first vertical blanking adjustment signal (discharge signal DIS2A) for the offset period.

As described above, fine timing adjustment can be easily implemented without changing the timing relationship between the latch pulse signals and the discharge signals by using the value set in the offset period setting register 150 when outputting the first and second latch pulse signals, the first and second horizontal blanking adjustment signals, and the first and second vertical blanking adjustment signals.

As shown in FIG. 8, the display controller 540 may include a vertical synchronization signal generation section 130. The vertical synchronization signal generation section 130 generates the vertical synchronization signal YD having pulses which specify one vertical scan period based on the number of horizontal display dots and the number of scan lines. The display controller 540 outputs the vertical synchronization signal YD to the first or second scan driver 530A or 530B. In FIG. 7, the vertical synchronization signal YD is output to the first scan driver 530A.

Figure 11:
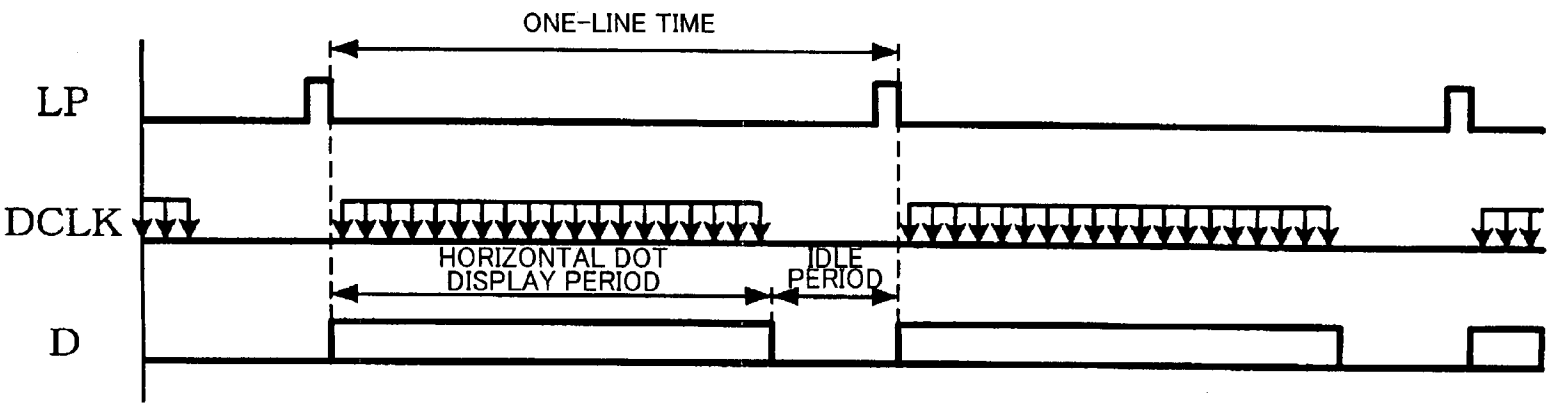
FIG. 11 is illustrative of the number of horizontal display dots.

FIG. 11 is illustrative of the number of horizontal display dots.

One horizontal scan period which is a one-line time may be defined as a period from one falling edge to the next falling edge of the latch pulse signal. The display controller 540 outputs the grayscale data D corresponding to the number of horizontal display dots to the data driver in horizontal scan period units. The one-line time may be defined as the sum of a horizontal dot display period and an idle period. For example, the one-line time is uniquely determined by deciding the frequency of the dot clock signal DCLK and setting the idle period and the number of horizontal display dots.

The vertical scan period includes such a one-line time in the number of scan lines. Therefore, the vertical synchronization signal YD having a pulse which specifies one vertical scan period can be generated based on the number of horizontal display dots, the number of scan lines, and the idle period set within one horizontal scan period.

As shown in FIG. 8, the display controller 540 may include a grayscale pulse setting register 160 for setting the edge of each grayscale pulse of the first grayscale clock signal GCLKA (GCLKRA to GCLKBA). The grayscale clock signal generation section 120 generates the first grayscale clock signals GCLKA (GCLKRA to GCLKBA) having first to N-th grayscale pulses, of which the interval between the change timing of the first horizontal blanking adjustment signal (discharge signal DIS1A) and the edge of the first grayscale pulse and the interval between the edge of the (i−1)th (2≦i≦N, i is an integer) grayscale pulse and the edge of the i-th grayscale pulse are set based on the value set in the grayscale pulse setting register 160, within a predetermined period (horizontal display period). The predetermined period is a period which starts at the change timing of the first horizontal blanking adjustment signal (discharge signal DIS1A) and ends at the next change timing of the first horizontal blanking adjustment signal (discharge signal DIS1A).

The grayscale clock signal generation section 120 generates the second grayscale clock signal GCLKB (GCLKRB to GCLKBB) having first to N-th grayscale pulses, of which the interval between the change timing of the second horizontal blanking adjustment signal (discharge signal DIS1B) and the edge of the first grayscale pulse and the interval between the edge of the (i−1)th (2≦i≦N, i is an integer) grayscale pulse and the edge of the i-th grayscale pulse are set based on the value set in the grayscale pulse setting register 160, within a predetermined period (horizontal display period). The predetermined period is a period which starts at the change timing of the second horizontal blanking adjustment signal (discharge signal DIS1B) and ends at the next change timing of the second horizontal blanking adjustment signal (discharge signal DIS1B).

Therefore, the timing of the edge of each grayscale pulse of the grayscale clock signal for specifying the change point of the PWM signal can be individually set. Therefore, PWM control performed within the horizontal display period defined by the change timings of the discharge signal can be finely performed.

2.3 Operation Principle

Figure 12:
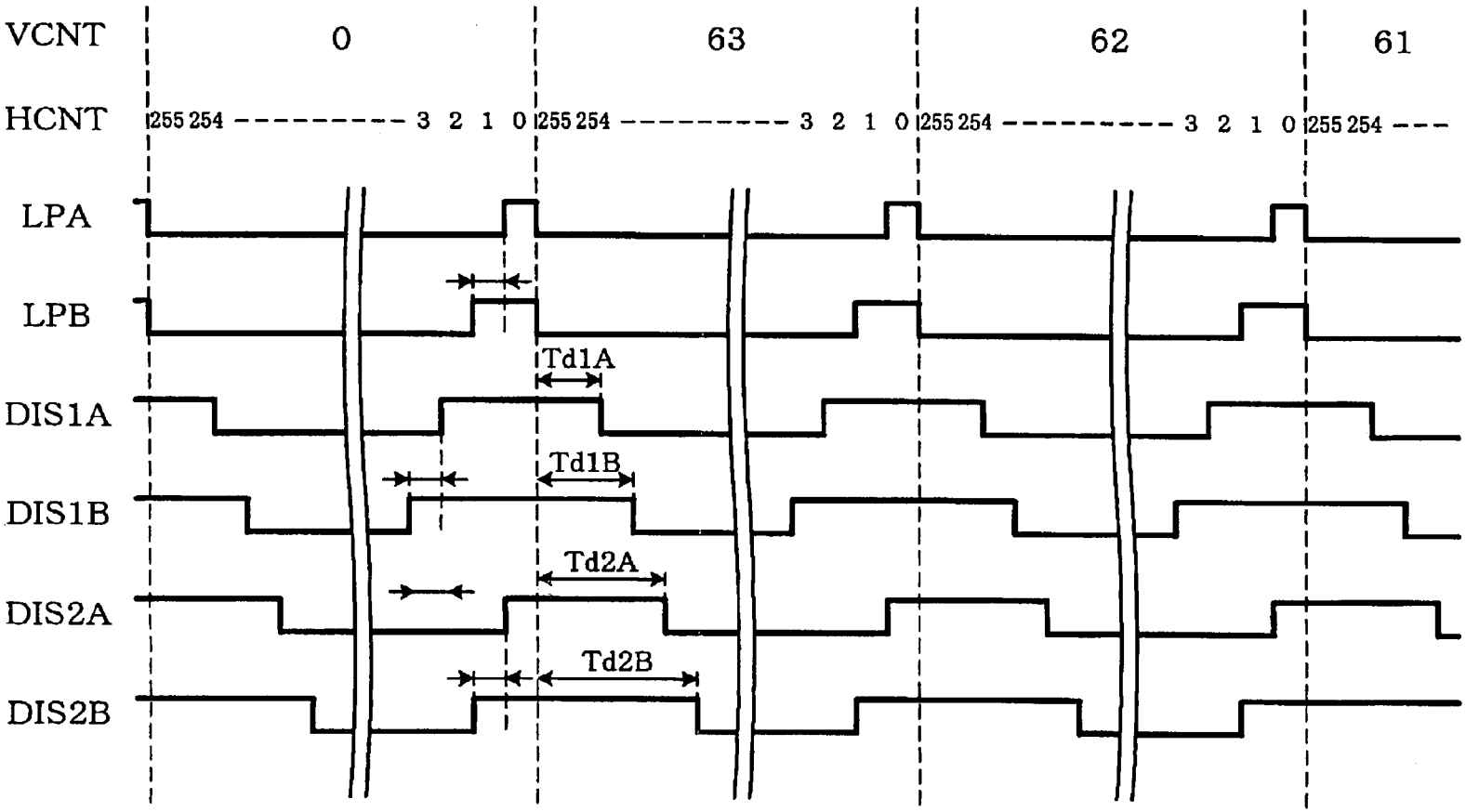
FIG. 12 is illustrative of the operation principle of a display controller in this embodiment.

FIG. 12 is illustrative of the operation principle of the display controller 540 in this embodiment. The display controller 540 generates various synchronization signals based on two count values VCNT and HCNT. The count value VCNT is decremented from "63" to "0" in units of one vertical scan period, for example. The count value HCNT is decremented from "255" to "0" in units of one horizontal scan period, for example. The change timings of the first and second latch pulse signals LPA and LPB and the discharge signals DIS1A, DIS1B, DIS2A, and DIS2B are specified by referring to the count values VCNT and HCNT.

For example, the discharge signal DIS1A is set at the L level when the count value HCNT has been decremented from "255" and the period corresponding to the value set in the first horizontal blanking period setting register 152 has elapsed. The same description also applies to the discharge signals DIS1B, DIS2A, and DIS2B.

For example, the first latch pulse signal LPA is set at the H level when the count value VCNT is "0" and the count value HCNT is "0". If the value set in the offset period setting register 150 is "1", the second latch pulse signal LPB is changed to the H level when the count value HCNT is "1". This enables the rising edge of the second latch pulse signal LPB to precede the rising edge of the first latch pulse signal LPA for a period corresponding to the value set in the offset period setting register 150.

2.4 Detailed Configuration Example

A detailed configuration example of the above-described display controller 540 is described below.

Figure 13:
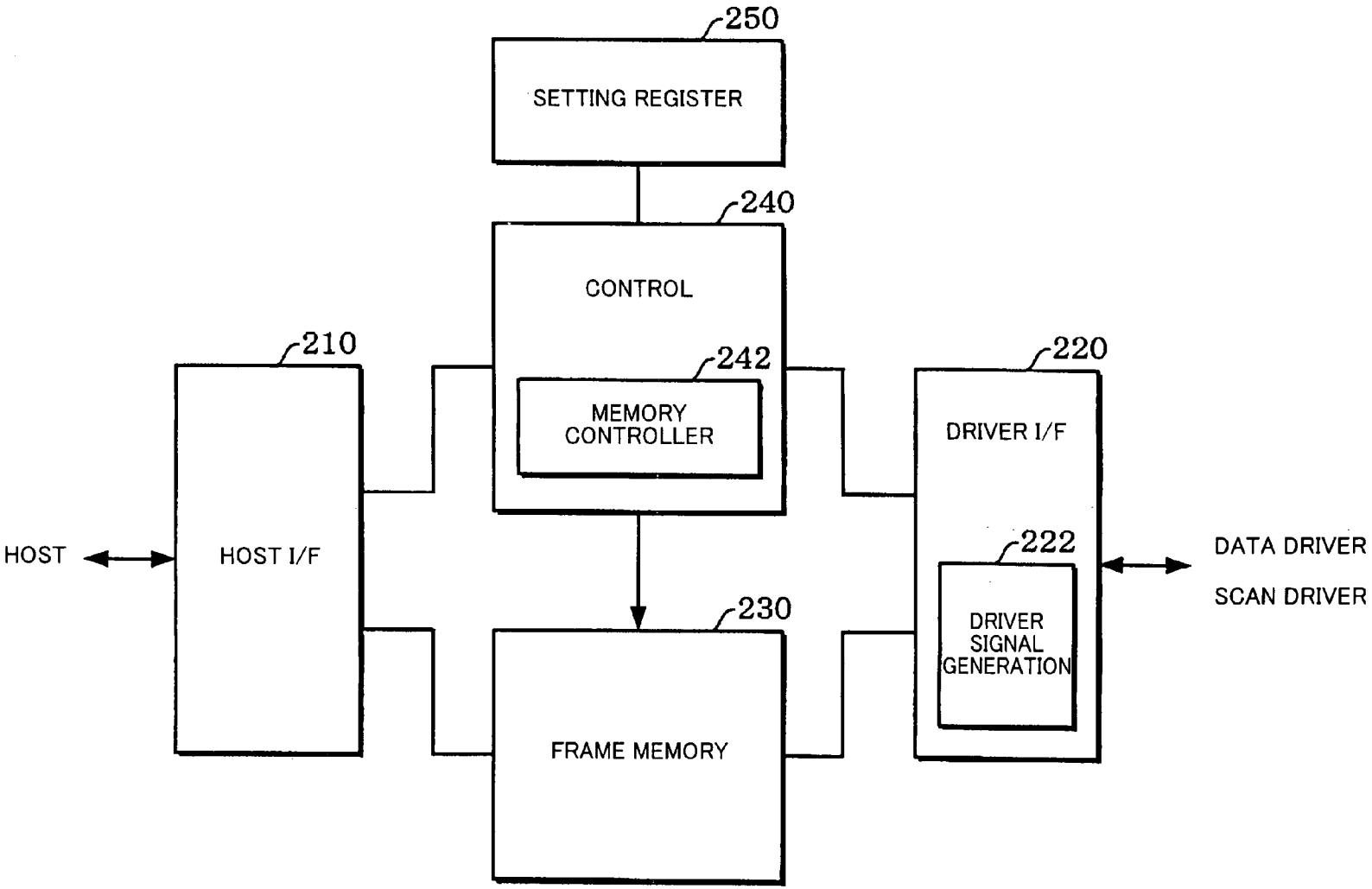
FIG. 13 is a block diagram of an outline of a configuration of a display controller in this embodiment.

FIG. 13 is a block diagram of an outline of a configuration of the display controller 540 in this embodiment.

The display controller 540 includes a host interface (hereinafter abbreviated as "I/F"210, a driver I/F 220, a frame memory 230, a control section 240, and a setting register section 250.

The host I/F 210 performs interface processing with the host 550. In more detail, the host I/F 210 controls transmission and reception of data and various control signals between the display controller 540 and the host 550.

The driver I/F 220 performs interface processing with the first and second data drivers 520A and 520B and the first and second scan drivers 530A and 530B. In more detail, the driver I/F 220 controls transmission and reception of data and various control signals between the display controller 540 and the first and second data drivers 520A and 520B and the first and second scan drivers 530A and 530B. The driver I/F 220 includes a driver signal generation section 222 which generates various display control signals to be transmitted to the first and second data drivers 520A and 520B and the first and second scan drivers 530A and 530B. The driver signal generation section 222 generates various display control signals based on a value set in the setting register section 250.

The frame memory 230 stores the grayscale data for one frame (for one vertical scan) supplied from the host 550 through the host I/F 210, for example. A value set in the setting register section 250 is set by the host 550 through the host I/F 210.

The control section 240 controls the host I/F 210, the driver I/F 220, the frame memory 230, and the setting register section 250.

In the display controller 540, the grayscale data is read from the frame memory 230 in a predetermined read cycle (every 1/160 seconds, for example), and the grayscale data is output to the data driver 520 through the driver I/F 220. Therefore, the write timing of the grayscale data from the host 550 into the frame memory 230 is asynchronous with the read timing of the grayscale data from the frame memory 230 into the data driver 520. The access control of the frame memory 230 is performed by a memory controller 242 in the control section 240.

Figure 14:
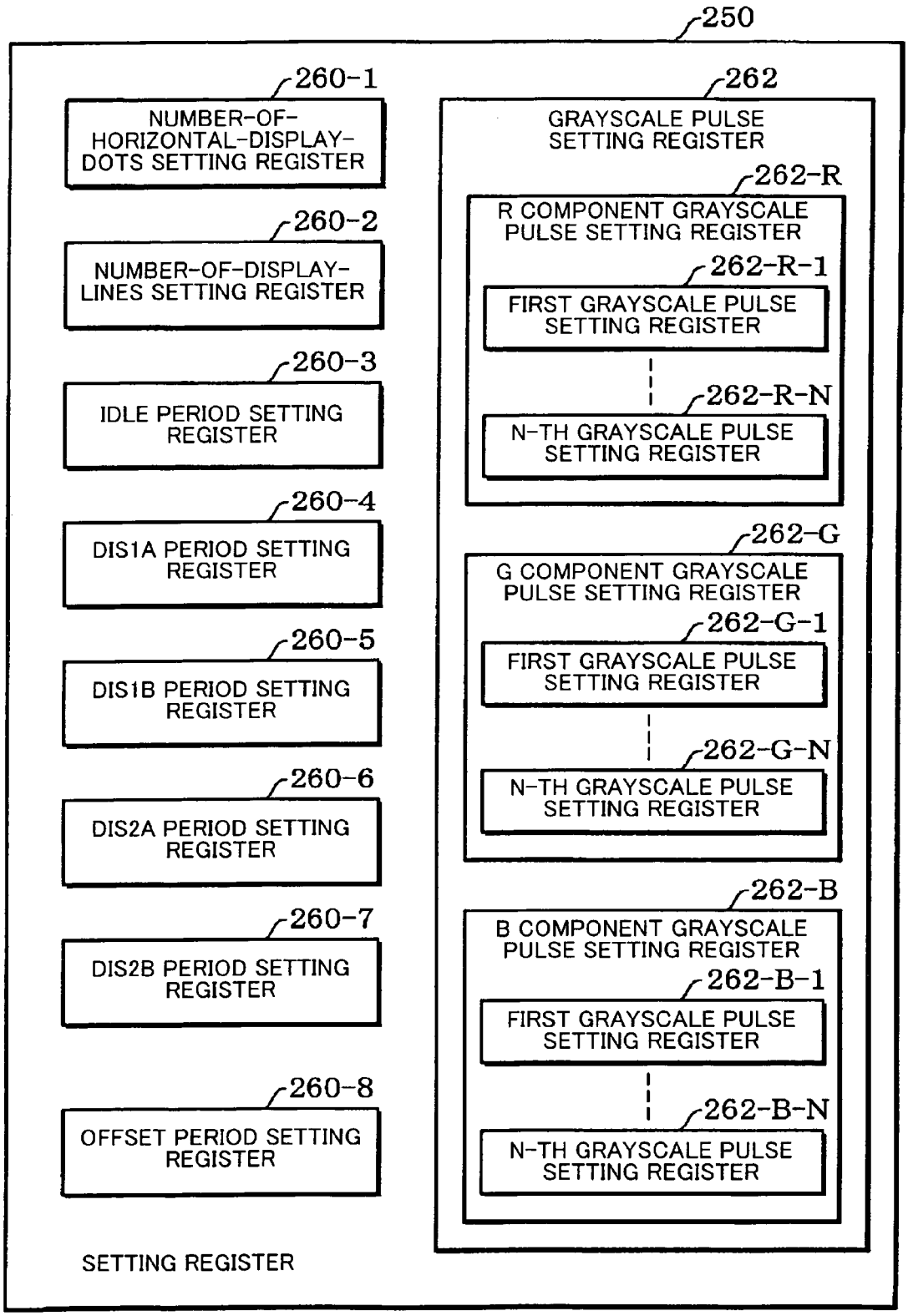
FIG. 14 is a block diagram of a configuration example of a setting register section.

FIG. 14 is a block diagram of a configuration example of the setting register section 250.

The number of horizontal display dots is set in a number-of-horizontal-display-dots setting register 260-1. In more detail, a value which is incremented by one in eight dot units is set in the number-of-horizontal-display-dots setting register 260-1. Therefore, the set value may be "(number of horizontal display dots /8)−1". This enables the number of bits of the number-of-horizontal-display-dots setting register 260-1 to be reduced.

The number of scan lines is set in a number-of-display-lines setting register 260-2. The number of cycles of the dot clock signal DCLK corresponding to the idle period is set in an idle period setting register 260-3. One vertical scan period can be determined based on the values set in the number-of-horizontal-display-dots setting register 260-1, the number-of-display-lines setting register 260-2, and the idle period setting register 260-3.

The number of cycles of the dot clock signal DCLK corresponding to the period Td1A from the falling edge of the first latch pulse signal LPA to the falling edge of the discharge signal DIS1A is set in a DIS1A period setting register 260-4. The DIS1A period setting register 260-4 corresponds to the first horizontal blanking period setting register 152 shown in FIG. 8.

The number of cycles of the dot clock signal DCLK corresponding to the period Td1B from the falling edge of the second latch pulse signal LPB to the falling edge of the discharge signal DIS1B is set in a DIS1B period setting register 260-5. The DIS1B period setting register 260-5 corresponds to the second horizontal blanking period setting register 154 shown in FIG. 8.

The number of cycles of the dot clock signal DCLK corresponding to the period Td2A from the falling edge of the first latch pulse signal LPA to the falling edge of the discharge signal DIS2A is set in a DIS2A period setting register 260-6. The DIS2A period setting register 260-6 corresponds to the first vertical blanking period setting register 156 shown in FIG. 8.

The number of cycles of the dot clock signal DCLK corresponding to the period Td2B from the falling edge of second latch pulse signal LPB to the falling edge of the discharge signal DIS2B is set in a DIS2B period setting register 260-7. The DIS2B period setting register 260-6 corresponds to the second horizontal blanking period setting register 158 shown in FIG. 8.

The number of cycles of the dot clock signal DCLK corresponding to the offset period is set in an offset period setting register 260-8. The offset period setting register 260-8 corresponds to the offset period setting register 150 shown in FIG. 8. A grayscale pulse setting register 262 corresponds to the grayscale pulse setting register 160 shown in FIG. 8.

The grayscale pulse setting register 262 includes an R component grayscale pulse setting register 262-R, a G component grayscale pulse setting register 262-G, and a B component grayscale pulse setting register 262-B. The grayscale pulse setting register for each color component is a register for setting the edges of N grayscale pulses of the R component grayscale clock signal. Therefore, the R component grayscale pulse setting register 262-R includes first to N-th grayscale pulse setting registers 262-R-1 to 262-R-N. The G component grayscale pulse setting register 262-G includes first to N-th grayscale pulse setting registers 262-G-1 to 262-G-N. The B component grayscale pulse setting register 262-B includes first to N-th grayscale pulse setting registers 262-B-1 to 262-B-N.

Figure 15:
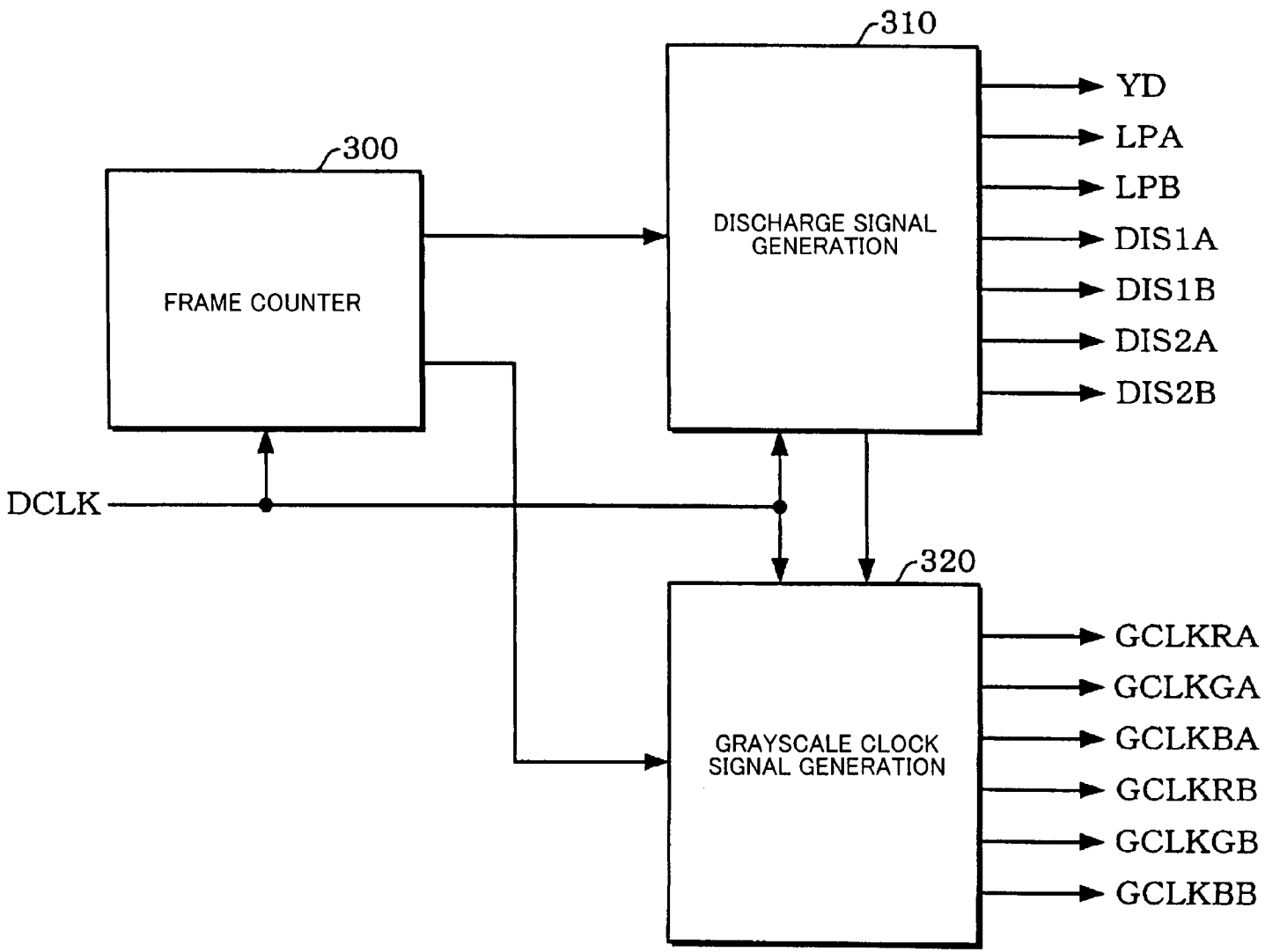
FIG. 15 is a block diagram of a configuration example of a driver signal generation section.

FIG. 15 is a block diagram of a configuration example of the driver signal generation section 222.

The driver signal generation section 222 includes a frame counter 300, a discharge signal generation section 310, and a grayscale clock signal generation section 320. The frame counter 300 performs a count operation for calculating the count values VCNT and HCNT. The discharge signal generation section 310 generates the vertical synchronization signal YD, the first and second latch pulse signals LPA and LPB, and the discharge signals DIS1A, DIS1B, DIS2A, and DIS2B based on the count operation of the frame counter 300. The grayscale clock signal generation section 320 generates the first and second grayscale clock signals GCLKRA to GCLKBA and GCLKRB to GCLKBB within the horizontal display period specified by the discharge signals DIS1A and DIS1B.

Figure 16:
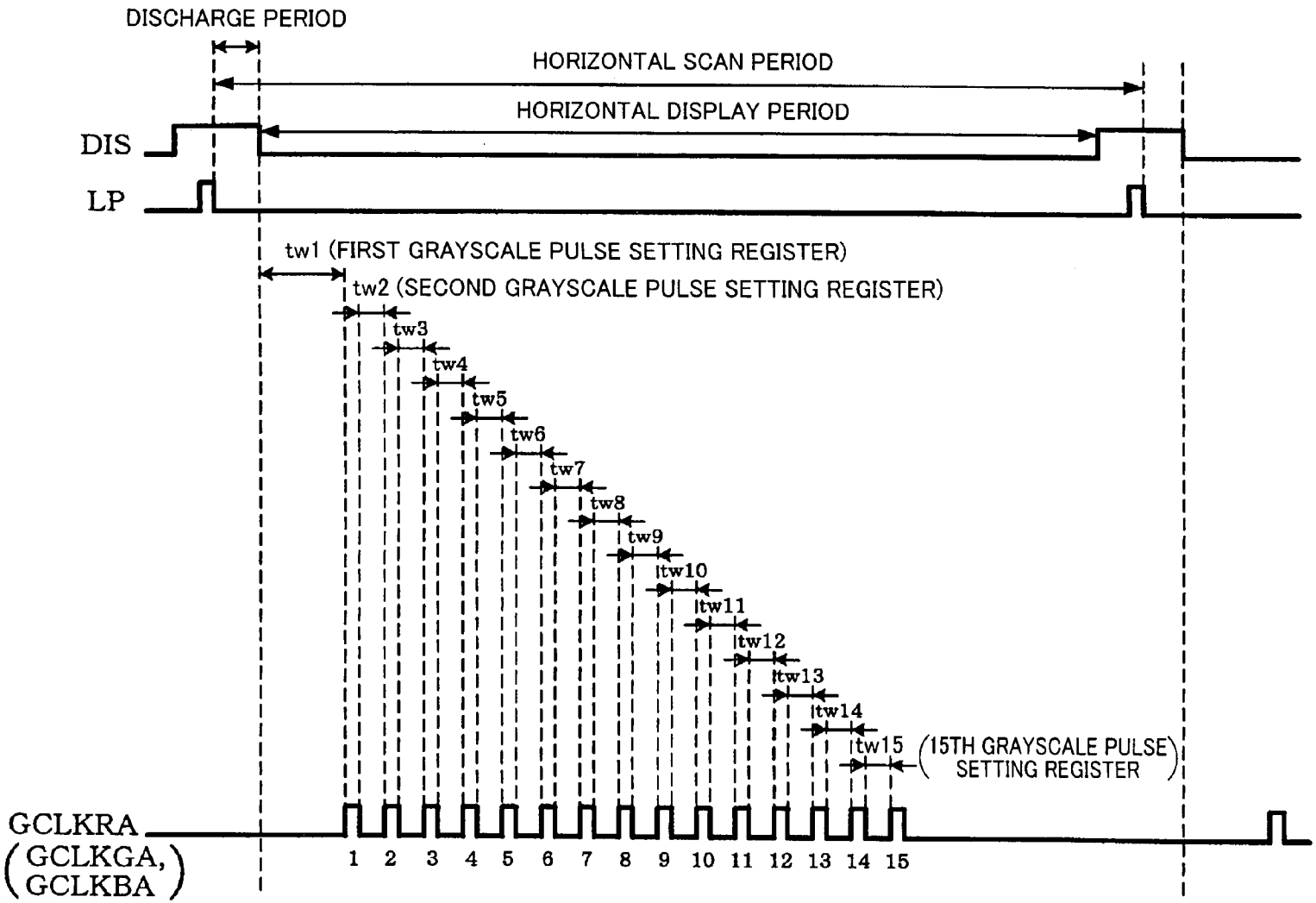
FIG. 16 is illustrative of a grayscale clock signal generated by a grayscale clock signal generation section.

FIG. 16 is illustrative of the grayscale clock signal generated by the grayscale clock signal generation section 320. FIG. 16 shows the R component grayscale clock signal GCLKRA when N is "15". However, the same description also applies to the case where N is another value or the color component is another color component.

The first grayscale pulse setting register 262-R-1 shown in FIG. 14 is a register for setting an interval tw1 between the reference timing which is the starting point of the horizontal display period and the edge (rising edge or falling edge) of the first grayscale pulse. The second grayscale pulse setting register 262-R-2 is a register for setting an interval tw2 between the edge of the first grayscale pulse and the edge of the second grayscale pulse. Specifically, the i-th ($2 \leqq i \leqq N$, i is an integer) grayscale pulse setting register is a register for setting an interval tw1 between the edge of the (i−1)th grayscale pulse and the edge of the i-th grayscale pulse.

Figure 17:
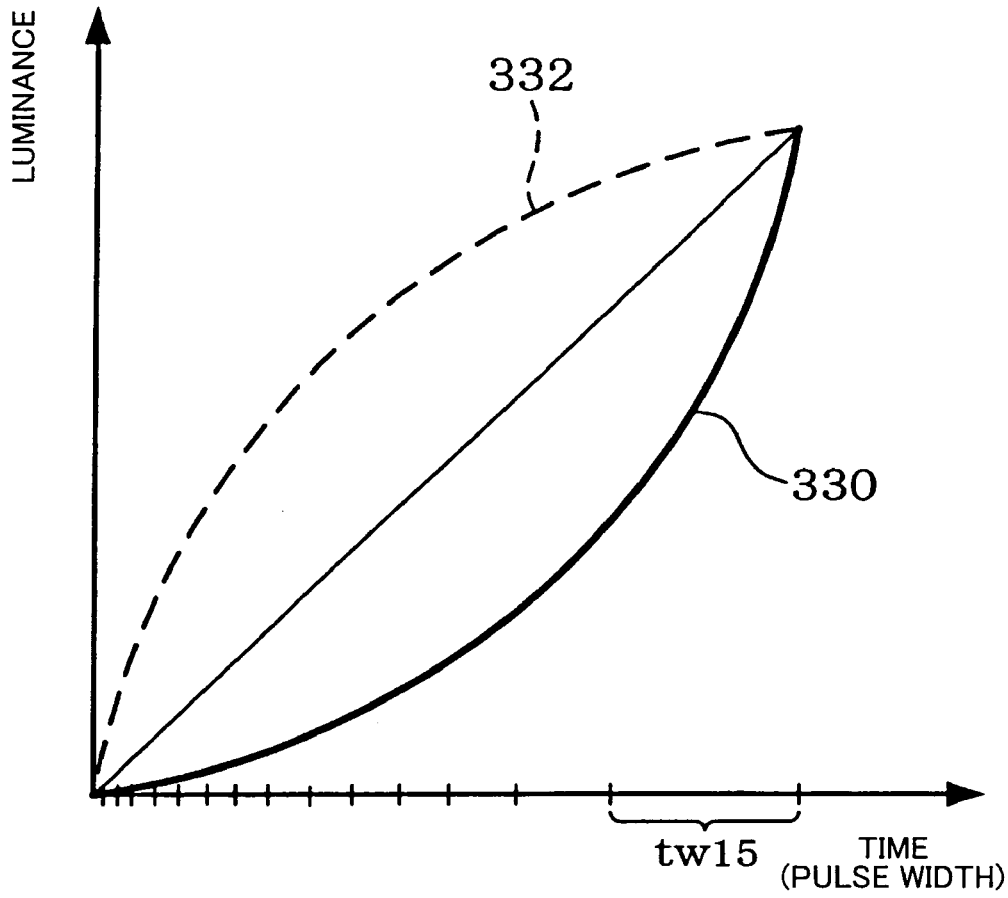
FIG. 17 shows an example of organic EL grayscale characteristics.

As described above, since the grayscale clock signal generation section 320 can separately set the timing of the edge of each grayscale pulse of the grayscale clock signal GCLK for specifying the change point of the PWM signal, gamma correction which corrects a characteristic curve 330 of the organic EL panel 510 as shown in FIG. 17 is implemented, whereby the organic EL panel 510 can be finely controlled so that characteristics such as a gamma correction curve 332 are obtained. According to the characteristic diagram shown in FIG. 17, it is necessary to increase the interval between the grayscale pulses (pulse width of the grayscale clock signal) as the luminance is increased in order to obtain luminance (grayscale) specified by discrete grayscale data.

Since the grayscale clock signals GCLKRA to GCLKBA, of which the interval between the grayscale pulses can be set, can be generated for each color component, the pulse width of the PWM signal can be caused to differ even if the value of the grayscale data is the same. This enables a desired grayscale representation to be implemented by performing fine gamma correction for each color component, even if the luminance differs to a large extent between each color component of the organic EL panel 510. Since the manufacturing technology of the organic EL panel is immature differing from the liquid crystal panel and the variation between each color component is great, it is particularly effective that fine gamma correction can be implemented for each color component.

Figure 18:
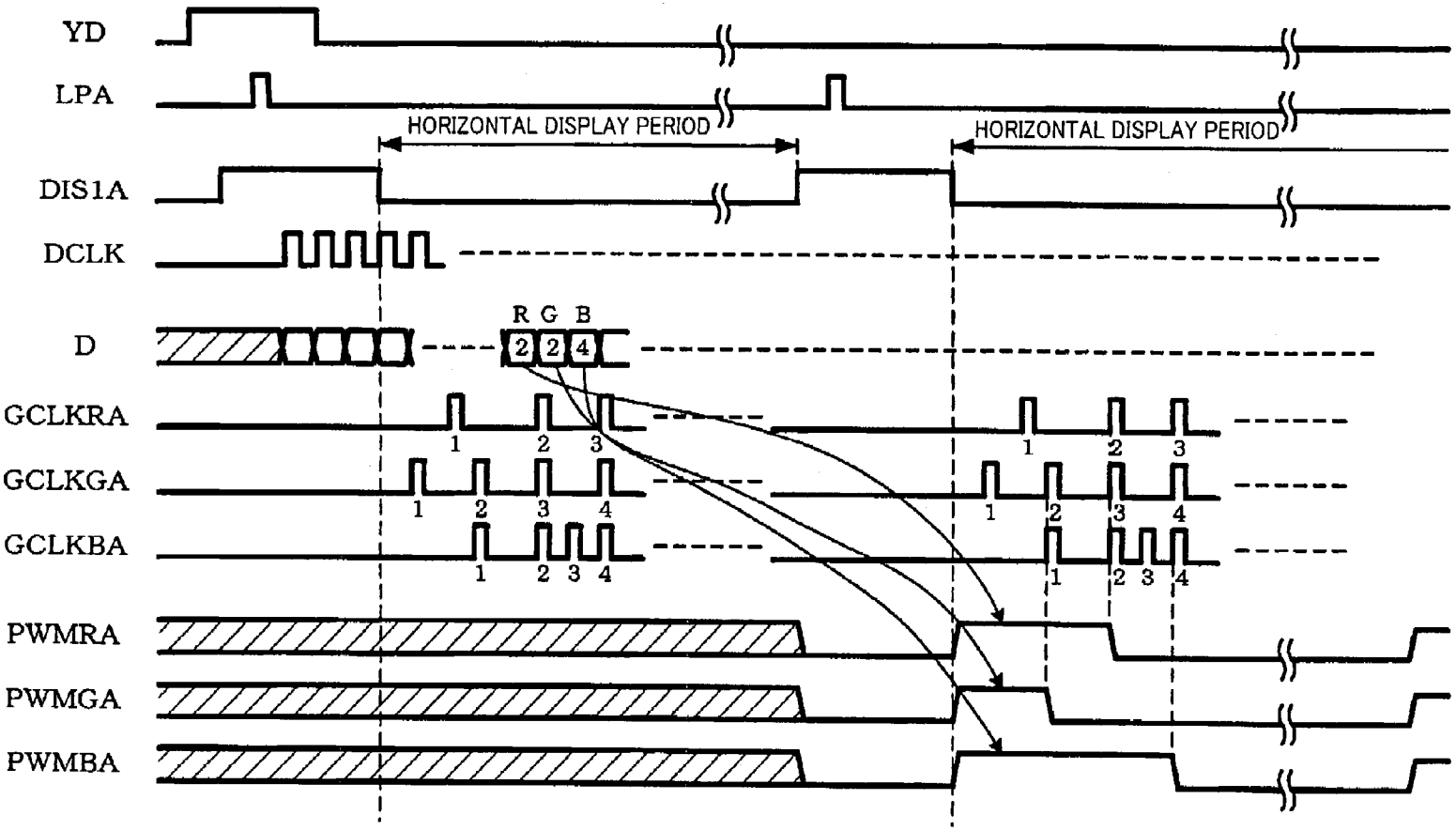
FIG. 18 is a timing diagram of an operation example of generating a PWM signal by using the grayscale clock signal shown in FIG. 16.

FIG. 18 is a timing diagram of an operation example of generating the PWM signals using the grayscale clock signals GCLKRA to GCLKBA shown in FIG. 16.

One vertical scan period starts when the pulse of the vertical synchronization signal YD is input from the display controller 540. One horizontal scan period starts when the pulse of the horizontal synchronization signal LPA is input from the display controller 540 in a period in which the vertical synchronization signal YD is set at the H level. The horizontal display period starts based on the timing at which the discharge signal DIS1A from the display controller 540 is changed from the H level to the L level as the reference timing. The horizontal display period ends at the timing at which the discharge signal DIS1A is changed to the H level.

In the horizontal display period, the display controller 540 outputs the dot clock signal DCLK, and sequentially outputs the color component grayscale data in synchronization with the dot clock signal DCLK. The grayscale clock signal generation section 320 outputs the grayscale clock signals GCLKRA, GCLKGA, and GCLKBA within the horizontal display period based on the R component grayscale pulse setting register 262-R, the G component grayscale pulse setting register 262-G, and the B component grayscale pulse setting register 262-B.

The data driver 520 which has stored the grayscale data from the display controller 540 in the shift register latches the grayscale data in one horizontal scan unit in the line latch based on the horizontal synchronization signal LPA in a period in which the discharge signal DIS1A is set at the H level. Therefore, the first data driver 520A generates PWM signals PWMRA, PWMGA, and PWMBA corresponding to the grayscale data in the horizontal scan period subsequent to the horizontal scan period in which the grayscale data from the display controller 540 is supplied. In FIG. 18, since the R component grayscale data is "2", the pulse width of the PWM signal PWMRA is a period from the falling edge of the discharge signal DIS1A to the edge of the second grayscale pulse. Since the G component grayscale data is "2", the pulse width of the PWM signal PWMGA is a period from the falling edge of the discharge signal DIS1A to the edge of the second grayscale pulse. Since the B component grayscale data is "4", the pulse width of the PWM signal PWMBA is the period from the falling edge of the discharge signal DIS1A to the edge of the fourth grayscale pulse. As described above, since the interval between the grayscale pulses of the grayscale clock signal can be caused to differ for each color component, the PWM signals having different pulse widths can be generated for the color components of which the values of the grayscale data are the same.

Moreover, the horizontal display period is made variable by adjusting the horizontal blanking period using the discharge signal DIS1A, and the interval between the grayscale pulses can be caused to differ within the horizontal display period. This enables the pulse width of the PWM signal to be set as the absolute value corresponding to the size of the organic EL panel 510 and the type of the organic EL element, whereby a desired grayscale representation can be easily achieved.

FIG. 18 shows the case where the interval between the reference timing and the grayscale pulse or the interval between the grayscale pulses is set at the rising edge of each grayscale pulse. However, the interval may be set at the falling edge of the grayscale pulse.

FIGS. 16 to 18 illustrate the first grayscale clock signals GCLKRA to GCLKBA supplied to the first data driver 520A. However, the same description also applies to the second grayscale clock signals GCLKRB to GCLKBB supplied to the second data driver 520B. In FIG. 14, the edge of each pulse of the first and second grayscale clock signals GCLKRA to GCLKBA and GCLKRB to GCLKBB is set using the grayscale pulse setting register 262 shown in FIG. 14. However, the edges of each grayscale pulse may be separately set.

2.4.1 Frame Counter

Figure 19:
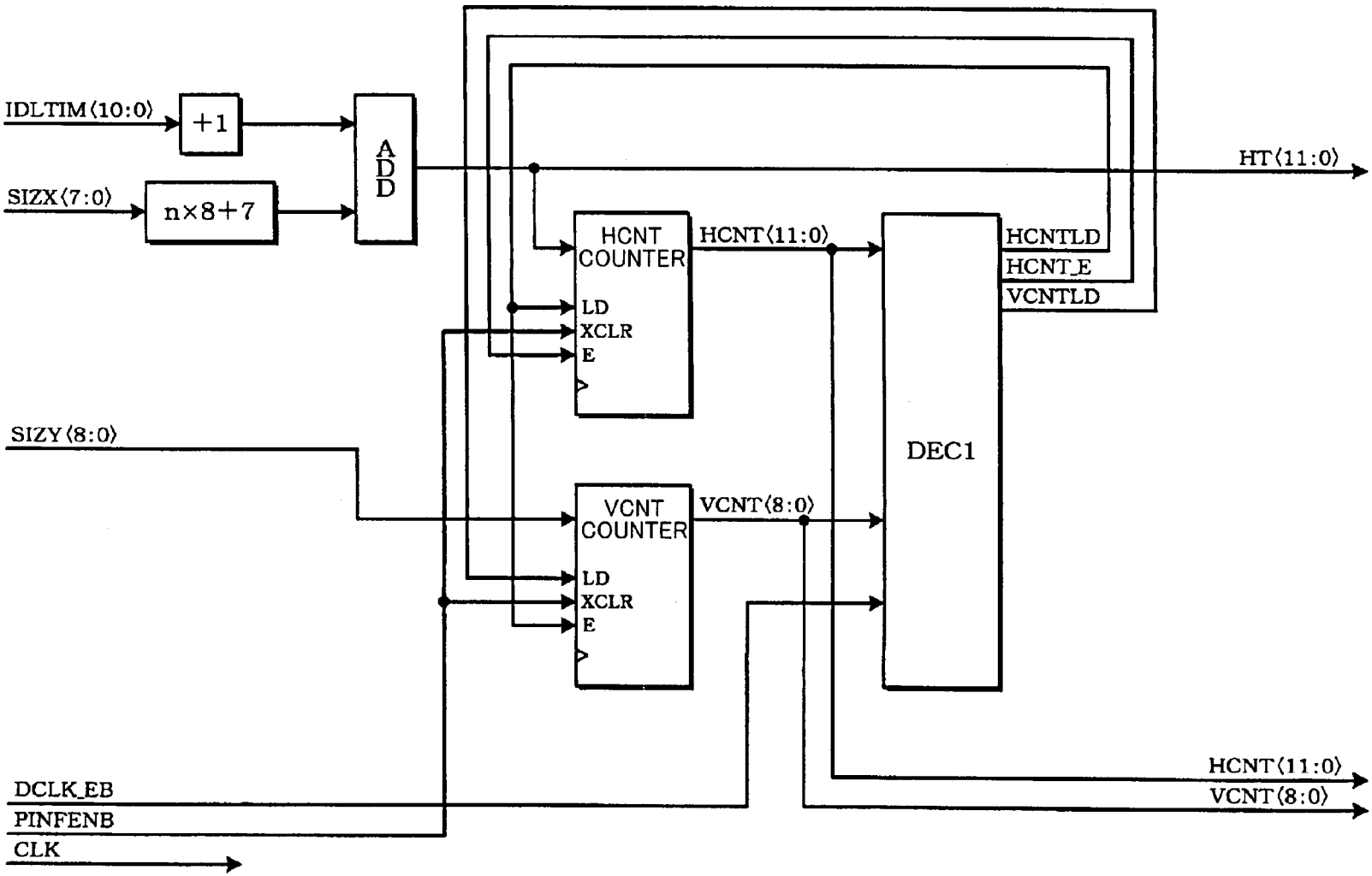
FIG. 19 is a block diagram of a circuit configuration example of a frame counter.

FIG. 19 is a block diagram of a circuit configuration example of the frame counter 300. The system clock signal CLK is supplied to each block. The dot clock signal DCLK may be a signal obtained by dividing the frequency of the system clock signal CLK.

A value IDLTIM<10:0> set in the idle period setting register 260-3, a value SIZX<7:0> set in the number-of-horizontal-display-dots setting register 260-1, and a value SIZY<8:0> set in the number-of-display-lines setting register 260-3 are input to the frame counter 300. Since the value SIZX<7:0> set in the number-of-horizontal-display-dots setting register 260-1 is designated in eight dot units, the value SIZX<7:0> is multiplied by eight, and seven is added to the resulting value. A value obtained by adding the addition result to a value obtained by adding one to the value IDLTIM<10:0> set in the idle period setting register 260-3 is a count value HT<11:0> indicating the one-line time. A signal DCLK_EB is an edge signal of the dot clock signal DCLK. An IF enable signal PINFENB is an enable signal of the driver I/F 220.

FIG. 20A is an example of a truth table illustrative of an operation of an HCNT counter. FIG. 20B is an example of a truth table illustrative of an operation of a VCNT counter. FIG. 20C is an example of a truth table illustrative of an operation of a decoder DEC1.

In FIG. 20A, the HCNT counter is reset when a signal input to an XRST terminal (not shown) is set at the L level (0), and operates in synchronization with the system clock signal CLK input to a CLK terminal. An initial value is loaded in synchronization with the rising edge of the system clock signal CLK when a signal input to the XRST terminal is set at the H level (1) and a signal input to an XCLR terminal is set at the L level. The value HT<11:0> is loaded in synchronization with the rising edge of the system clock signal CLK when a load signal input to an LD terminal is set at the H level (1). A count value HCNT is decremented in synchronization with the rising edge of the system clock signal CLK when the load signal is set at the L level (0) and an enable signal input to an E terminal is set at the H level.

In FIG. 20B, the truth table is expressed in the same manner as in FIG. 20A. Therefore, detailed description is omitted. In FIG. 20C, each signal shown in the column of the signal name is set at the H level when the condition is true.

Figure 21:
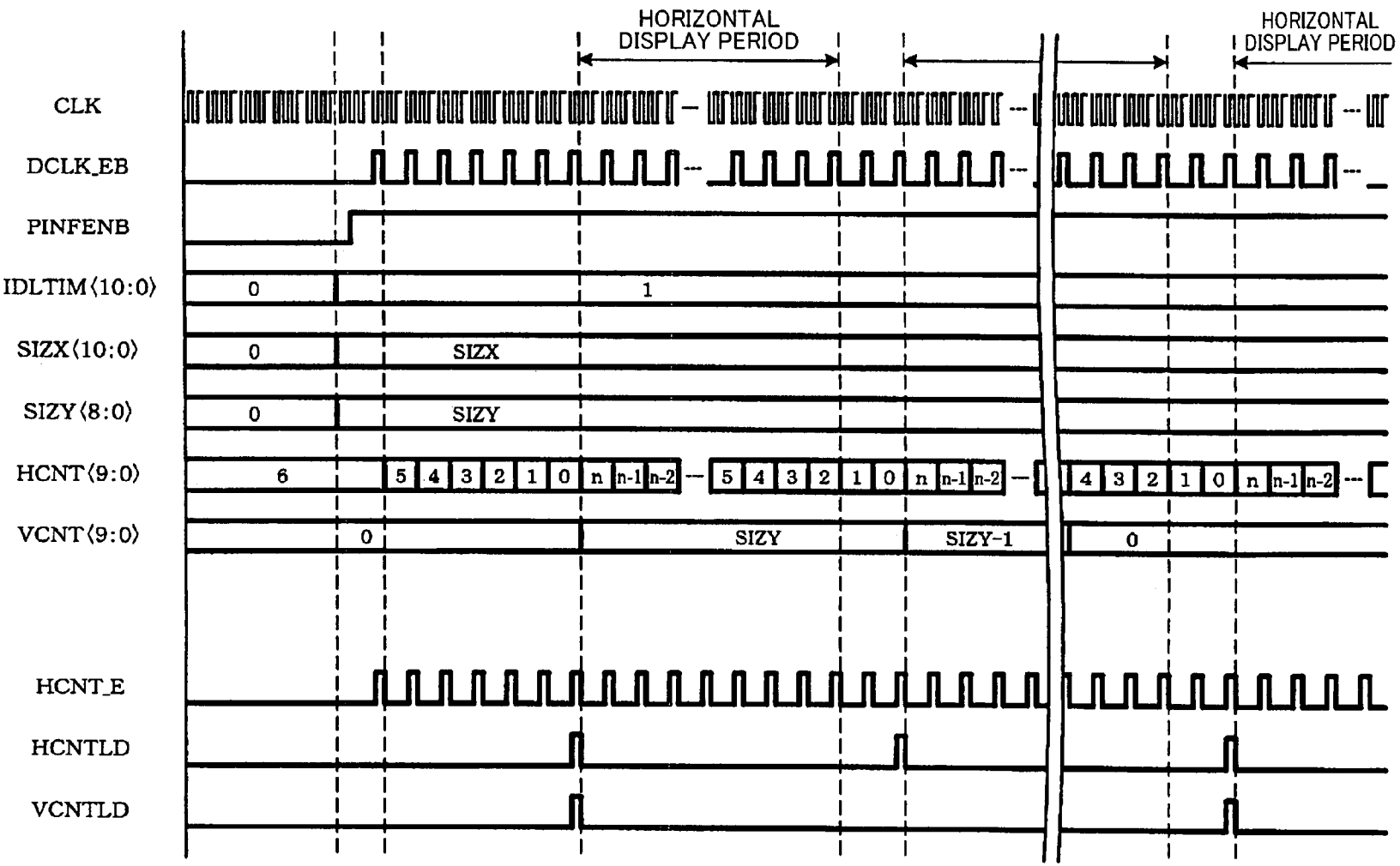
FIG. 21 is a timing diagram of an operation example of the frame counter shown in FIG. 19.

FIG. 21 is a timing diagram of an operation example of the frame counter 300 shown in FIG. 19. FIG. 21 shows the case where the value IDLTIM is "1" (idle period is "2").

The count value HCNT is decremented in synchronization with a signal HCNT_E output in units of the dot clock signal DCLK. The count value VCNT is decremented in synchronization with a signal VCNTLD. In FIG. 21, n may be (SIZX+IDLTIM+1).

2.4.2 Discharge Signal Generation Section

Figure 22:
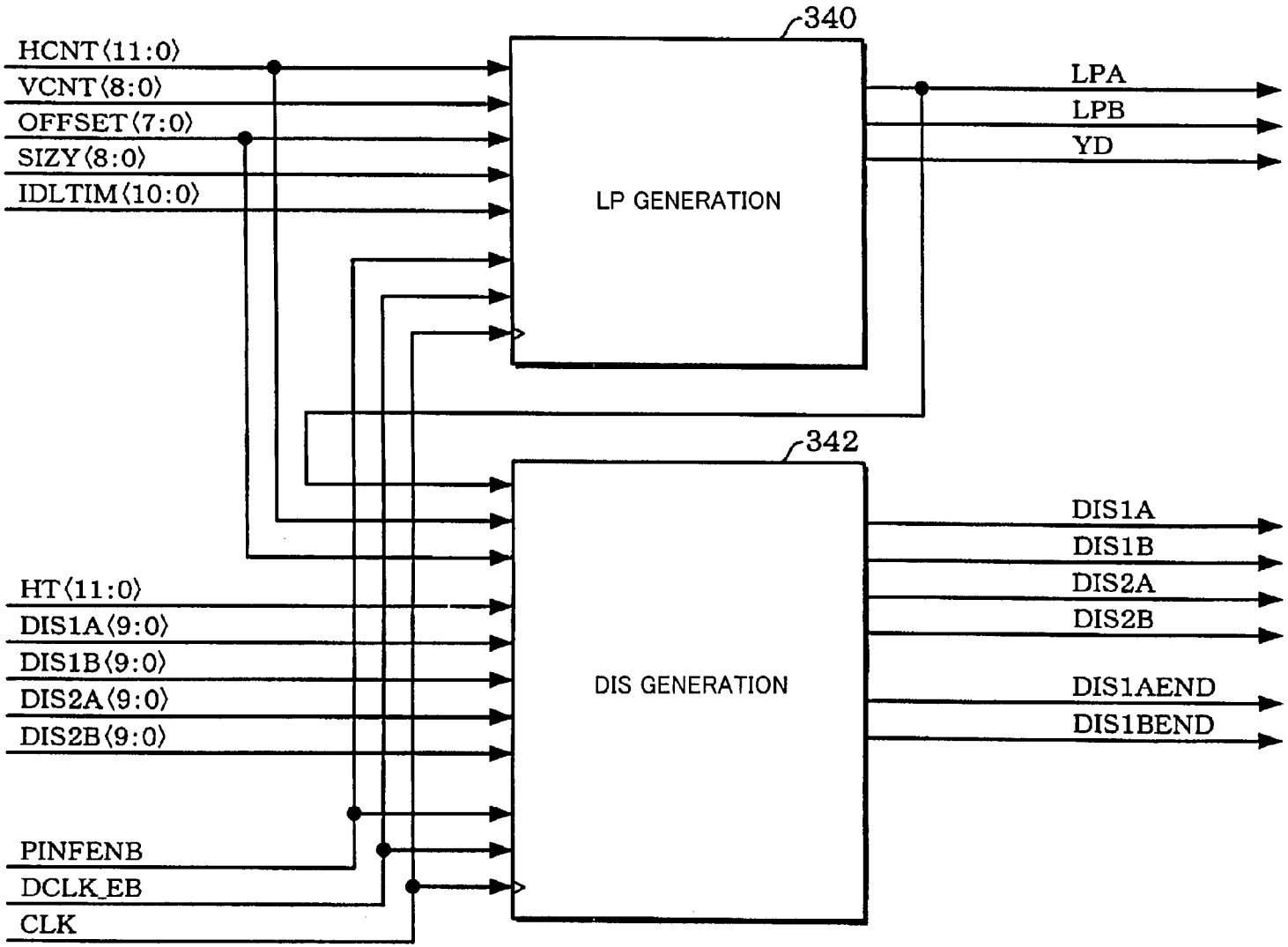
FIG. 22 is a block diagram of a circuit configuration example of a discharge signal generation section.

FIG. 22 is a block diagram of a circuit configuration example of the discharge signal generation section 310. The system clock signal CLK is supplied to each block.

The value IDLTIM<10:0> set in the idle period setting register 260-3, the value SIZY<7:0> set in the number-of-display-lines setting register 260-2, and a value OFFSET<7:0> set in the offset period setting register 260-8 are input to the discharge signal generation section 310. A value DIS1A<9:0> set in the DIS1A period setting register 260-4, a value DIS1B<9:0> set in the DIS1B period setting register 260-5, a value DIS2A<9:0> set in the DIS2A period setting register 260-6, and a value DIS2B<9:0> set in the DIS2B period setting register 260-7 are input to the discharge signal generation section 310. The count value HCNT<11:0>, the count value VCNT<8:0>, and the count value HT<11:0> of the one-line time are input to the discharge signal generation section 310.

The discharge signal generation section 310 includes an LP generation section 340 and a DIS generation section 342. The LP generation section 340 generates the first and second latch pulse signals LPA and LPB and the vertical synchronization signal YD. The DIS generation section 342 generates the discharge signals DIS1A, DIS1B, DIS2A, and DIS2B.

Figure 23:
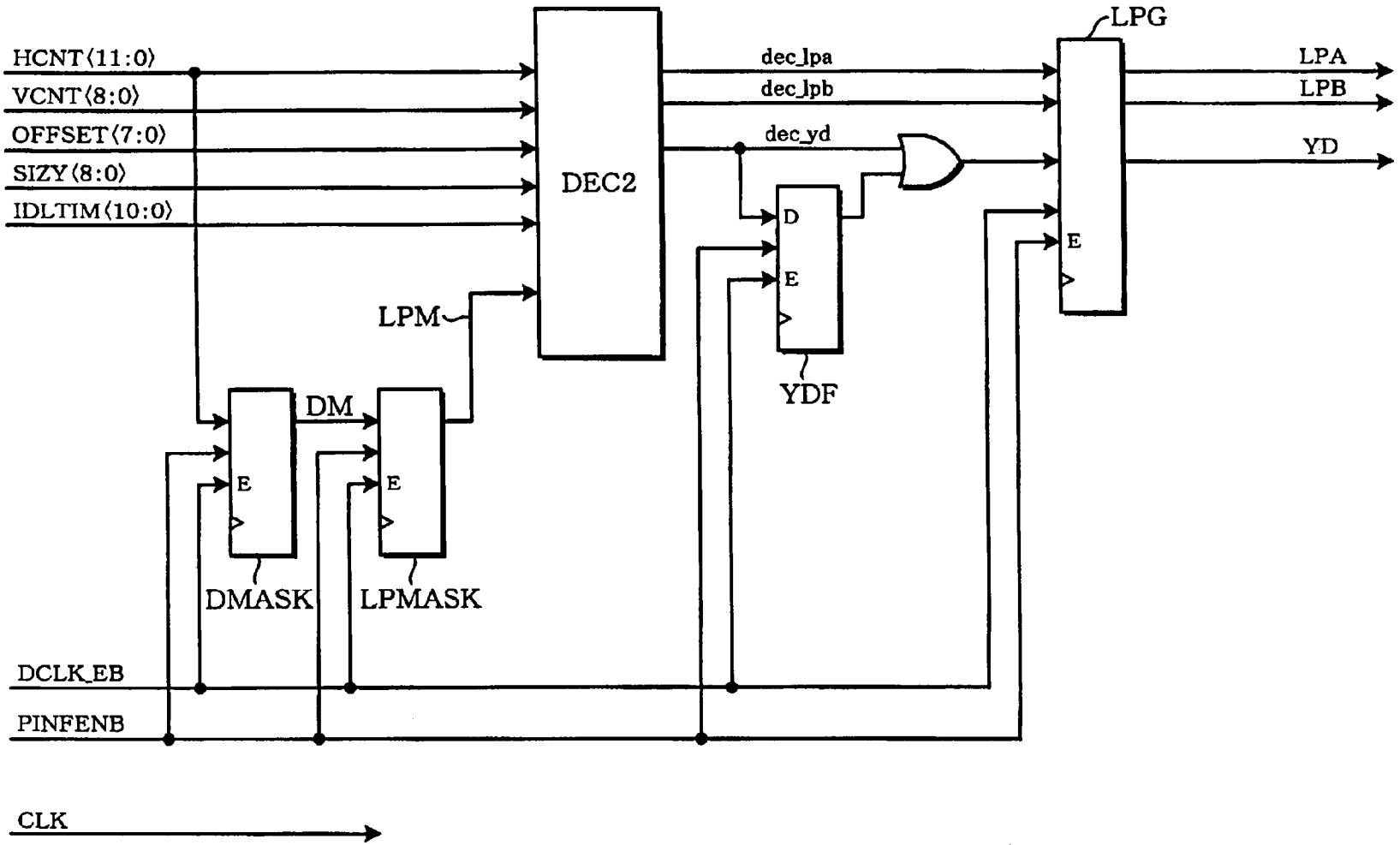
FIG. 23 is a block diagram of a circuit configuration example of an LP generation section.

FIG. 23 is a block diagram of a circuit configuration example of the LP generation section 340. The system clock signal CLK is supplied to each block.

In the LP generation section 340, a signal DM generated by a DCLK mask generation circuit DMASK is supplied to an LP mask generation circuit LPMASK. A signal LPM generated by the LP mask generation circuit LPMASK is input to a decoder DEC2. An output from the decoder DEC2 is retimed by an LP generation circuit LPG.

FIG. 24A is an example of a truth table illustrative of an operation of the DCLK mask generation circuit DMASK.

FIG. 24B is an example of a truth table illustrative of an operation of the LP mask generation circuit LPMASK. FIG. 24C is an example of a truth table illustrative of an operation of the decoder DEC2.

In FIGS. 24A and 24B, the DCLK mask generation circuit DMASK and the LP mask generation circuit LPMASK are reset when a signal input to an XRESET terminal (not shown) is set at the L level, and operate in synchronization with the rising edge of the system clock signal CLK. The DCLK mask generation circuit DMASK sets the signal DM to "1" when the count value HCNT is "1" and the signal DCLK_EB is set at the H level. The LP mask generation circuit LPMASK sets the signal LPM to "1" when the signal DM is "1" and the signal DCLK_EB is set at the H level.

The decoder DEC2 sets a signal dec_lpa at the H level when the count value HCNT is "1" and the signal LPM is "0". The decoder DEC2 sets a signal dec_lpb at the H level when the count value HCNT is equal to or less than the value OFFSET and the signal LPM is "0". Therefore, the signals Dec_lpa and dec_lpb of which the rising timings differ for the value OFFSET and the fall timings are the same can be generated. The decoder DEC2 sets a signal dec_yd at the H level when the count value HCNT is equal to or less than the value IDLTIM and the count value VCNT is equal to the value SIZY.

A flip-flop YDF is cleared when the signal PINFENB is set at the L level. The H level period is increased for one cycle of the signal DCLK_EB by the logical OR of the output from the flip-flop YDF and the signal dec_yd.

The LP generation circuit LPG is cleared when the signal PINFENB is set at the L level. The signals dec_lpa and dec_lpb and the above logical OR result are retimed in synchronization with the signal DCLK_EB.

Figure 25:
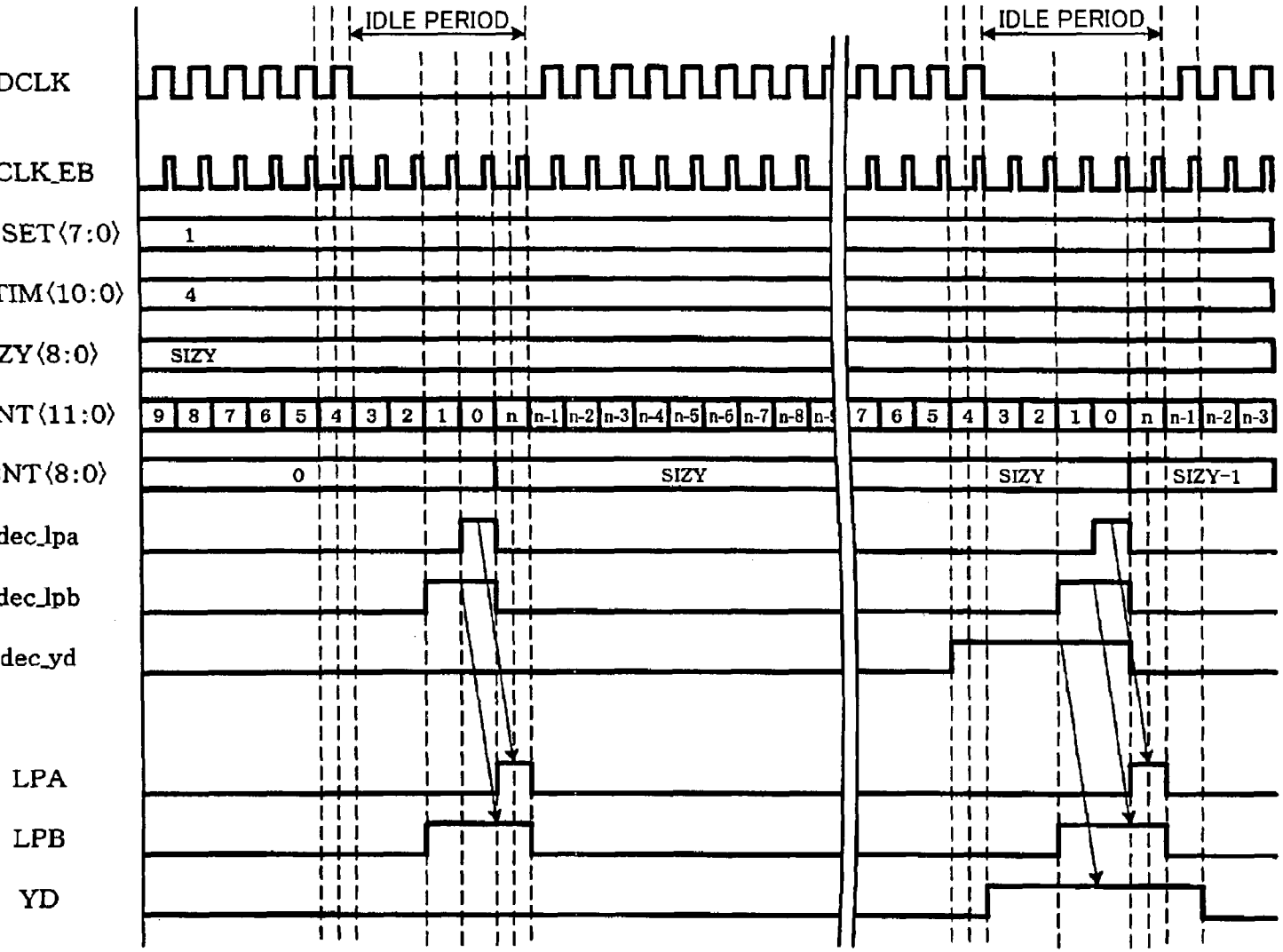
FIG. 25 is a timing diagram of an operation example of the LP generation section shown in FIG. 23.

FIG. 25 is a timing diagram of an operation example of the LP generation section 340 shown in FIG. 23. FIG. 25 shows the case where the value IDLTIM is "4" (idle period is "5"and the value OFFSET is "1". In FIG. 25, the LP generation circuit LPG retimes the second latch pulse signal LPB so that the signal dec_lpb at the H level is output as is.

Figure 26:
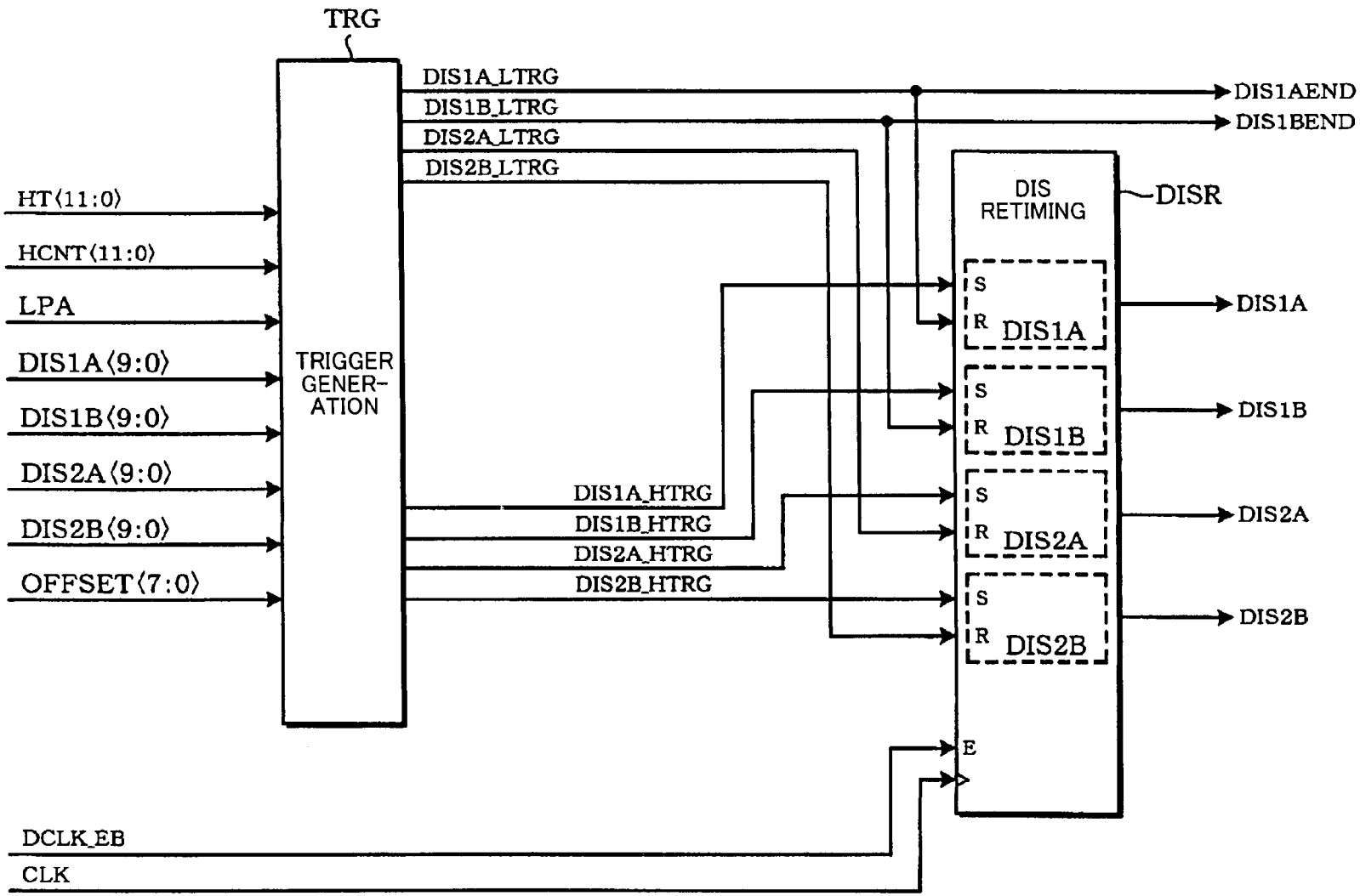
FIG. 26 is a block diagram of a circuit configuration example of a DIS generation section.

FIG. 26 is a block diagram of a circuit configuration example of the DIS generation section 342. The system clock signal CLK is supplied to each block.

The DIS generation section 342 includes a trigger generation circuit TRG and a DIS retiming circuit DISR. The trigger generation circuit TRG generates triggers for setting the discharge signals DIS1A, DIS1B, DIS2A, and DIS2B at the H level or the L level based on the count values HT<11:0> and HCNT<11:0>, the first latch pulse signal LPA, and the values DIS1A<9:0>, DIS1B<9:0>, DIS2A<9:0>, and DIS2B<9:0> set in the discharge period setting registers.

FIG. 27 shows an example of a truth table illustrative of an operation of the trigger generation circuit TRG. In FIG. 27, each signal shown in the column of the signal name is set at the H level when the condition is true. For example, a signal DIS1A_LTRG is set at the H level when the difference between the count value HT of the one-line time and the value DIS1 A set in the DIS1A period setting register 260-4 coincides with the count value HCNT. The signal DIS1A_LTRG is a trigger for resetting the discharge signal DIS1A to the L level. Signals DIS1B_LTRG, DIS2A_LTRG and DIS2B_LTRG are output in the same manner as the signal DIS1A_LTRG. Signals DIS1A_HTRG, DIS1B_HTRG DIS2A_HTRG, and DIS2B_HTRG which are triggers for setting the discharge signals at the H level are output in the same manner as the signal DIS1A_LTRG.

The DIS retiming circuit DISR outputs the discharge signal DIS1A which is set by the signal DIS1A_HTRG in synchronization with the signal DCLK_EB and is reset by the signal DIS1A_LTRG. The DIS retiming circuit DISR outputs the discharge signal DIS1B which is set by the signal DIS1B_HTRG in synchronization with the signal DCLK_EB and is reset by the signal DIS1B_LTRG. The DIS retiming circuit DISR outputs the discharge signal DIS2A which is set by the signal DIS2A_HTRG in synchronization with the signal DCLK_EB and is reset by the signal DIS2A_LTRG. The DIS retiming circuit DISR outputs the discharge signal DIS2B which is set by the signal DIS2B_HTRG in synchronization with the signal DCLK_EB and is reset by the signal DIS2B_LTRG.

Figure 28:
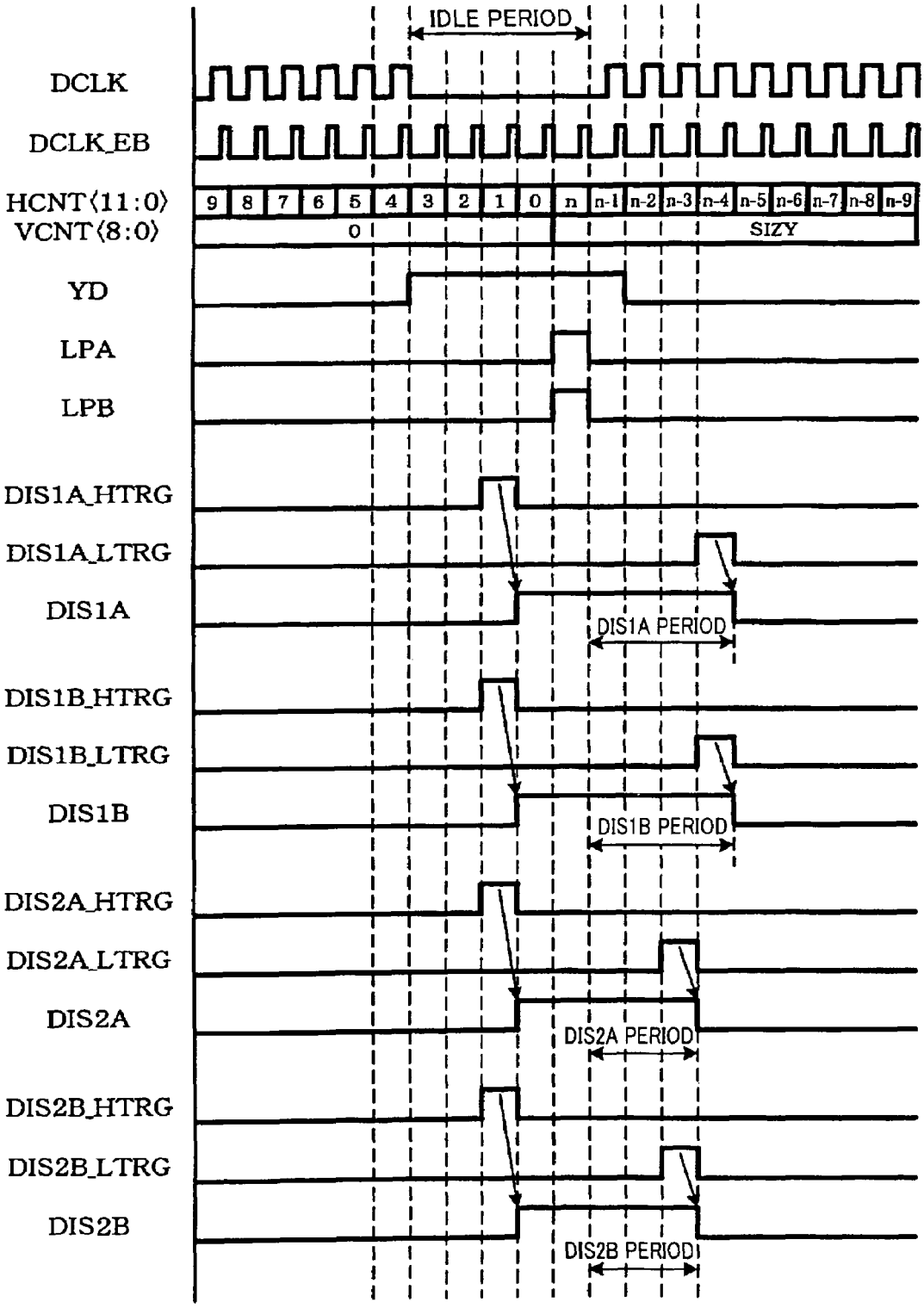
FIG. 28 is a timing diagram of an operation example of the DIS generation section when an offset period is "0".

FIG. 28 is a timing diagram of an operation example of the DIS generation section 342 when the offset period is "0". In FIG. 28, the idle period is "5", the offset period is "0", the value DIS1A<9:0> set in the DIS1A period setting register 260-4 is "4", the value DIS1B<9:0> set in the DIS1B period setting register 260-5 is "4", the value DIS2A<9:0> set in the DIS2A period setting register 260-6 is "3", and the value DIS2B<9:0> set in the DIS2B period setting register 260-7 is "3".

Figure 29:
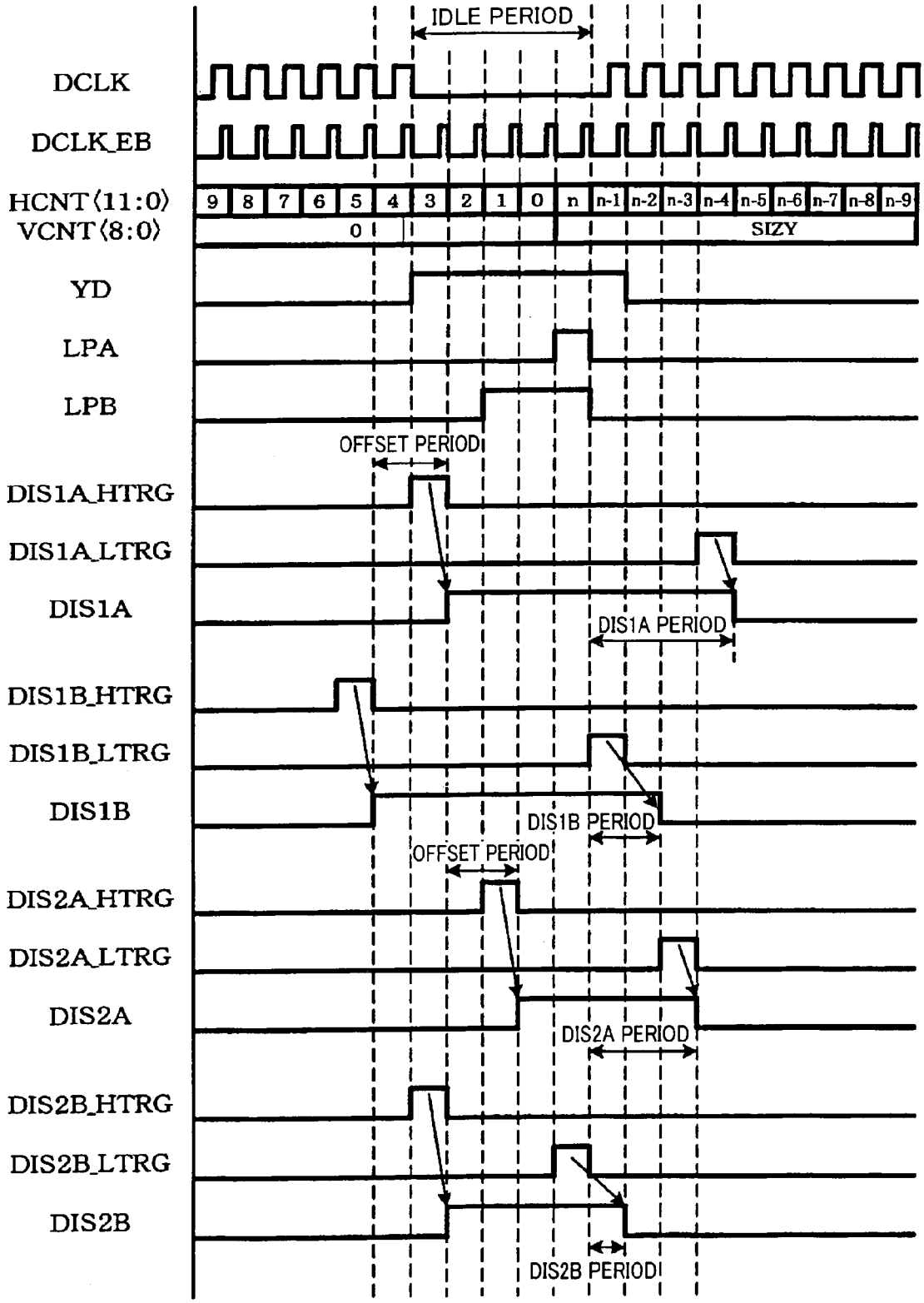
FIG. 29 is a timing diagram of an operation example of the DIS generation section when an offset period is "2".

FIG. 29 is a timing diagram of an operation example of the DIS generation section 342 when the offset period is "2".

As shown in FIGS. 28 and 29, the generation timings of the triggers for setting the discharge signals DIS1B and DIS2B at the H level are determined corresponding to the value set in the offset period setting register. The generation timings of the triggers for setting the discharge signals DIS1B and DIS2B at the L level are determined corresponding to the value set in the DIS1B and DIS2B period setting registers. The discharge signals DIS1B and DIS2B can be respectively changed before the discharge signals DIS1A and DIS2A by changing the timings of the triggers for setting the discharge signals DIS1B and DIS2B at the H level.

2.4.3 Grayscale Clock Signal Generation Section

Figure 30:
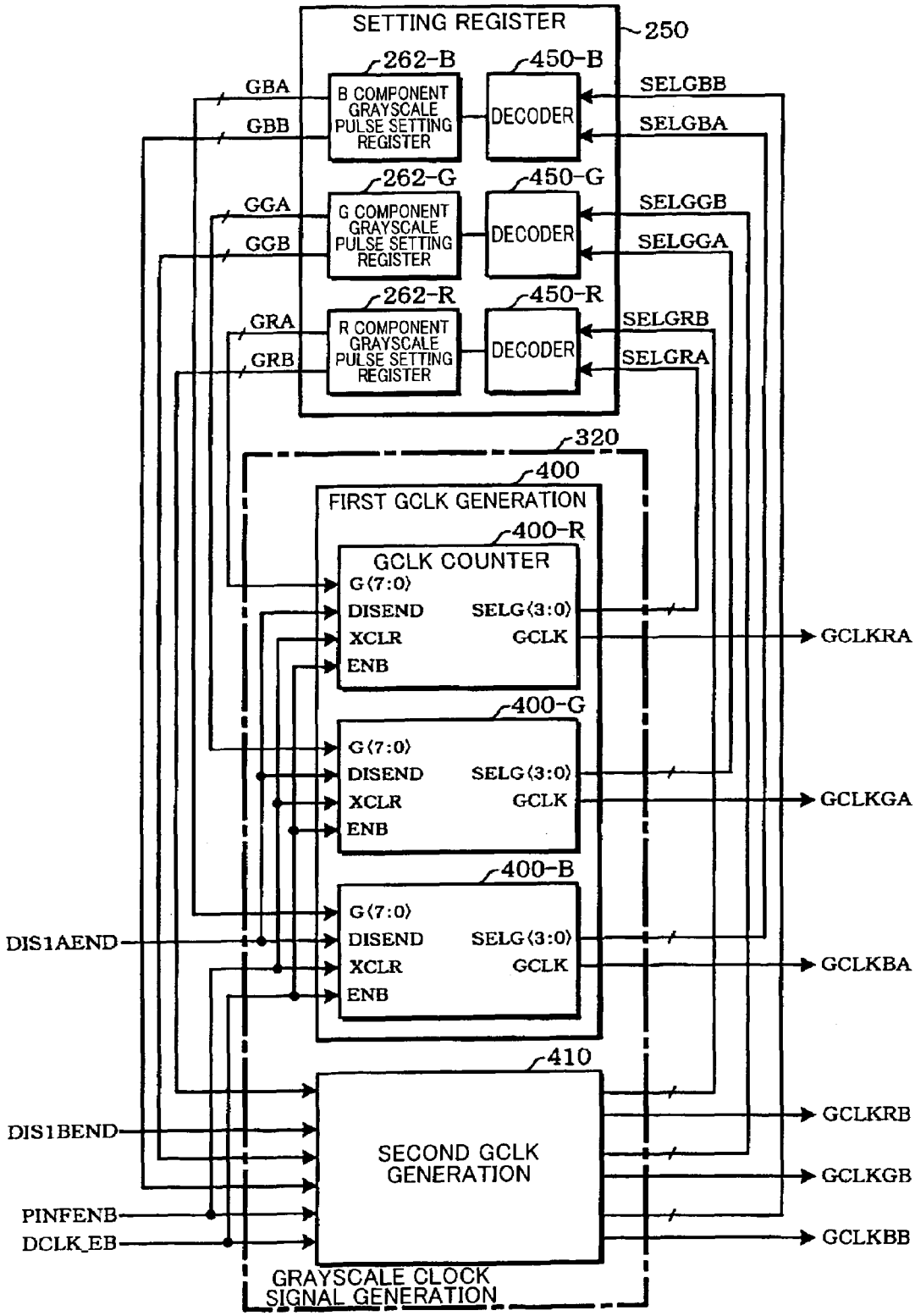
FIG. 30 is a block diagram of a circuit configuration example of a grayscale clock signal generation section.

FIG. 30 is a block diagram of a circuit configuration example of the grayscale clock signal generation section 320. The system clock signal CLK (not shown) is input to each section of the grayscale clock signal generation section 320, and each section operates in synchronization with the system clock signal CLK.

The grayscale clock signal generation section 320, includes a first GCLK generation section 400 and a second GCLK generation section 410. The first GCLK generation section 400 includes a GCLK counter 400-R which functions as an R component grayscale clock signal generation section, a GCLK counter 400-G which functions as a G component grayscale clock signal generation section, and a GCLK counter 400-B which functions as a B component grayscale clock signal generation section. The GCLK counters 400-R to 400-B have the same configuration.

The second GCLK generation section 410 has a configuration the same as the configuration of the first GCLK generation section 400. Specifically, the second GCLK generation section 410 includes a GCLK counter 410-R (not shown) which functions as an R component grayscale clock signal generation section, a GCLK counter 410-G (not shown) which functions as a G component grayscale clock signal generation section, and a GCLK counter 410-B (not shown) which functions as a B component grayscale clock signal generation section.

Data GRA<7:0> set in one of the first to fifteenth grayscale pulse setting registers 262-R-1 to 262-R-15 of the R component grayscale pulse setting register 262-R is input to the GCLK counter 400-R. A discharge end signal DIS1AEND indicating the falling edge of the discharge signal DIS1A, the IF enable signal PINFENB which is the enable signal of the driver I/F 220, and the DCLK edge signal DCLK_EB indicating the falling edge of the dot clock signal DCLK are input to the GCLK counter 400-R. The GCLK counter 400-R outputs the R component grayscale clock signal GCLKRA and a signal SELGRA<3:0> for selecting the next grayscale pulse setting register.

The GCLK counters 400-G and 400-B are the same as the GCLK counter 400-R, to which the G component or B component signal is input and which output the G component or B component signal instead of the R component signal. Therefore, description of the GCLK counters 400-G and 400-B is omitted.

The GCLK counter 410-R, the GCLK counter 410-G, and the GCLK counter 410-B of the second GCLK generation section 410 are the same as those of the GCLK counter 400-R. Therefore, description of these counters is omitted. However, a discharge end signal DIS1BEND indicating the falling edge of the discharge signal DIS1B is input to the second GCLK generation section 410 instead of the discharge end signal DIS1AEND.

The discharge end signals DIS1AEND and DIS1BEND are generated by the DIS generation section 342 shown in FIG. 26.

Figure 31:
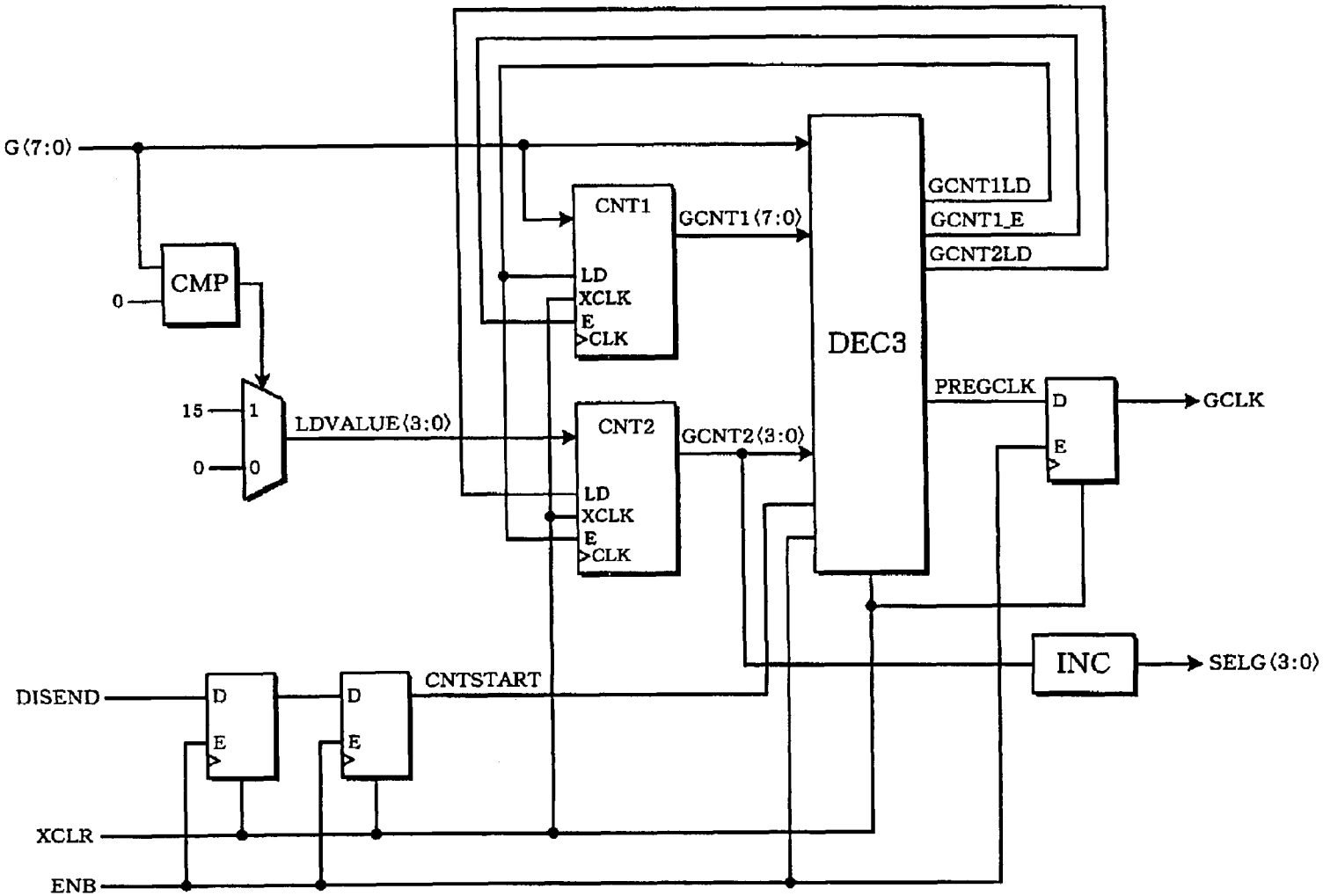
FIG. 31 is a block diagram of a circuit configuration example of a GCLK counter shown in FIG. 30.

FIG. 31 is a block diagram of a circuit configuration example of the GCLK counter.

The GCLK counter shown in FIG. 31 has a configuration the same as the configurations of the GCLK counters 400-R, 400-G, 400-B, 410-R, 410-G, and 410-B shown in FIG. 30. The system clock signal CLK is input to each circuit section shown in FIG. 31, and the internal state of each circuit section is initialized by a clear signal XCLR.

The GCLK counter includes a pulse width counter CNT1 and a grayscale counter CNT2. The pulse width counter CNT1 counts the interval until occurrence of the edge of the next grayscale pulse by decrementing the set data G<7:0>. Specifically, the pulse width counter CNT1 outputs the grayscale pulse so that the edge of the next grayscale pulse occurs when the data G<7:0> set in the grayscale pulse setting register is decremented to "0".

FIG. 32A shows a truth table of an operation of the pulse width counter CNT1.

FIG. 32A shows that the pulse width counter CNT1 operates in synchronization with the system clock signal CLK (not shown) input to a CLK terminal. For example, the set data G<7:0> is loaded in synchronization with the rising edge of the system clock signal CLK when a load signal input to an LD terminal is set at the H level (1). A count value GCNT1<7:0> is decremented in synchronization with the rising edge of the system clock signal CLK when the load signal is set at the L level (0) and an enable signal input to an E terminal is set at the H level, for example.

In FIG. 31, the grayscale counter CNT2 is a counter for specifying the current grayscale pulse. Specifically, the grayscale counter CNT2 increments a count value GCNT2<3:0> which is the pulse number for specifying the current grayscale pulse, and stops outputting the grayscale pulse when the count value GCNT2<3:0> has become "15". The set data of the pulse number decremented by the pulse width counter CNT1 is specified by the count value GCNT2<3:0>.

FIG. 32B shows a truth table of an operation of the grayscale counter CNT2. FIG. 32B shows that the grayscale counter CNT2 operates in synchronization with the system clock signal CLK (not shown) input to a CLK terminal. For example, a load value LDVALUE<3:0> is loaded in synchronization with the rising edge of the system clock signal CLK when a load signal input to an LD terminal is set at the H level (1). The count value GCNT2<3:0> is incremented in synchronization with the rising edge of the system clock signal CLK when the load signal is set at the L level and an enable signal input to an E terminal is set at the H level, for example.

The pulse width counter CNT1 and the grayscale counter CNT2 are enable-controlled and load-controlled by a decoder DEC3.

The count value GCNT1<7:0> from the pulse width counter CNT1, the count value GCNT2<3:0> from the grayscale counter CNT2, the enable signal ENB, a count start signal CNTSTART, and the like are input to the decoder DEC3. The decoder DEC3 outputs a pulse width counter load signal GCNT1LD, a pulse width counter enable signal GCNT1_E, a grayscale counter load signal GCNT2LD, and a pre-grayscale clock signal PREGCLK. The pulse width counter load signal GCNT1LD is supplied to the LD terminal of the pulse width counter CNT1 and the E terminal of the grayscale counter CNT2. The pulse width counter enable signal GCNT1_E is supplied to the E terminal of the pulse width counter CNT1. The grayscale counter load signal GCNT2LD is supplied to the LD terminal of the grayscale counter CNT2.

FIG. 32C shows a truth table of an operation of the decoder DEC3. In FIG. 32C, each signal shown in the column of the signal name is set at the H level when the condition is true.

The pulse width counter load signal GCNT1LD is set at the H level when the count start signal CNTSTART is set at the H level, or when the count value GCNT2 is not "15", the count value GCNT1 is "0", and the enable signal ENB is set at the H level. In this case, the pulse width counter CNT1 loads the data G<7:0>, and the grayscale counter CNT2 increments the count value GCNT2<3:0>.

The pulse width counter enable signal GCNT1_E is set at the H level when the count value GCNT2 is not "15" and the enable signal ENB is set at the H level. In this case, the pulse width counter CNT1 decrements the count value GCNT1<3:0>.

The pulse width counter load signal GCNT2LD is set at the H level when the count start signal CNTSTART is set at the H level, or when the count value GCNT1 is "0", the data G<7:0> is "0", and the enable signal ENB is set at the H level. In this case, the grayscale counter CNT2 loads the load value LDVALUE<3:0>.

The pre-grayscale clock signal PREGCLK is set at the H level when the count value GCNT1 <7:0> is "1".

As described above, the decoder DEC3 updates the pulse width counter load signal GCNT1LD, the pulse width counter enable signal GCNT1_E, and the grayscale counter load signal GCNT2LD when the enable signal ENB is set at the H level. Since the enable signal ENB of the decoder DEC3 is the DCLK edge signal DCLK_EB, the pulse width counter CNT1 is decremented in units of the dot clock signal DCLK. Specifically, the GCLK counter shown in FIG. 31 can output the grayscale clock signal GCLK of which the position of the edge can be adjusted in units of the dot clock signal DCLK.

Figure 33:
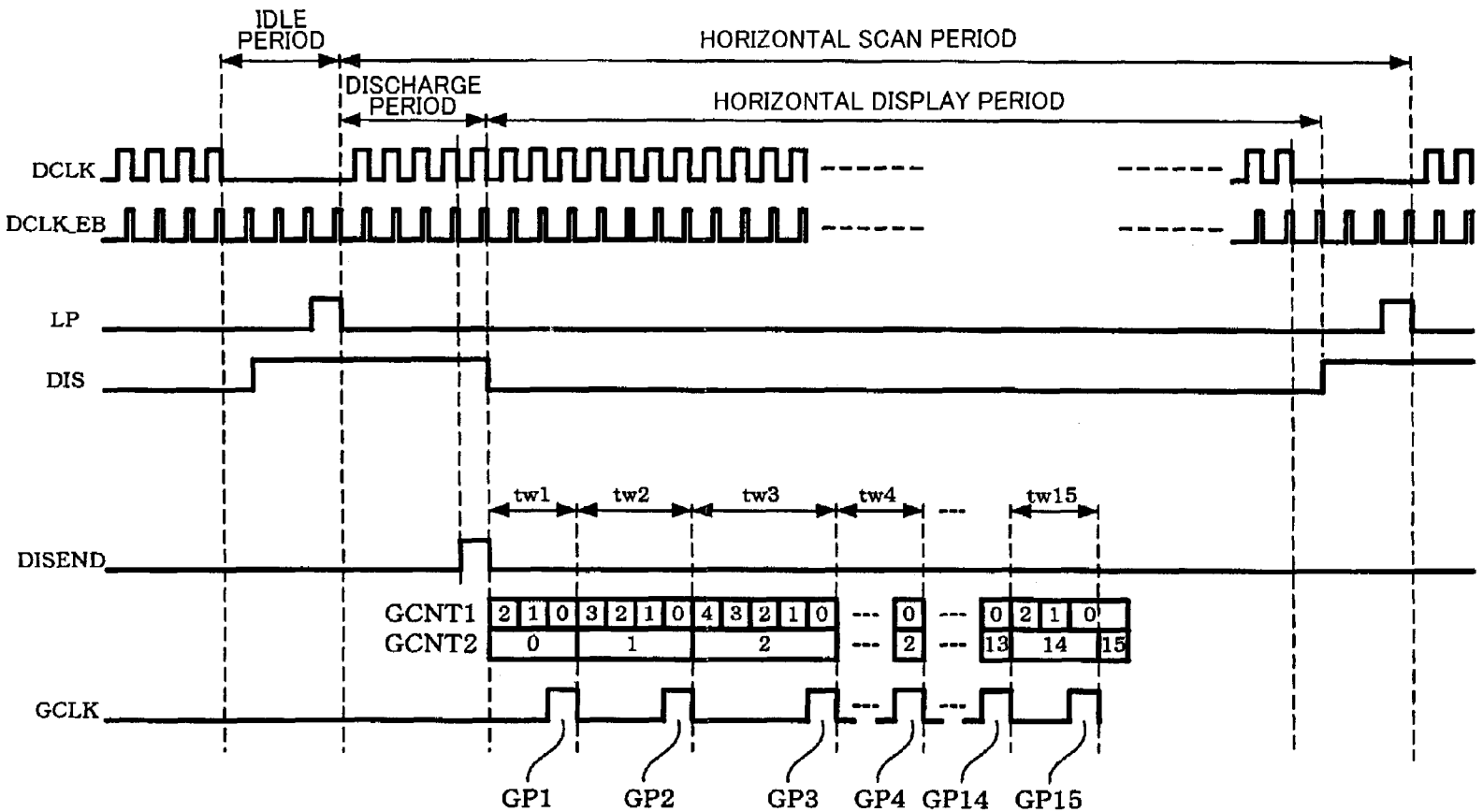
FIG. 33 is a timing diagram of an operation example of a grayscale clock signal generation section.

FIG. 33 is a timing diagram of an operation example of the grayscale clock signal generation section 320 having the configuration shown in FIGS. 30, 31, and 32A to 32C. In FIG. 33, the interval between the reference timing and the grayscale pulse or the interval between the grayscale pulses is set at the rising edge of the grayscale pulse.

In each GCLK counter, the count start signal CNTSTART is set at the H level when the discharge end signal DISEND is set at the H level based on the falling edge of the discharge signal. The data G<7:0> set in the first pulse width setting register is loaded into the pulse width counter CNT1. The pulse width counter CNT1 decrements the count value GCNT1<7:0> when the DCLK edge signal DCLK_EB (enable signal ENB) is set at the H level. The decoder DEC3 sets the pre-grayscale clock signal PREGCLK at the H level when the count value GCNT1<7:0> is "1".

The value set in the second grayscale pulse setting register is loaded into the pulse width counter CNT1 on condition that the count value GCNT1<7:0> has become "0". At the same time, the grayscale counter CNT2 increments the count value GCNT2<3:0>.

The pre-grayscale clock signal PREGCLK is retimed by the retiming circuit, and is output as the grayscale clock signal GCLK.

The count value GCNT2<3:0> is incremented by an incrementer INC and is supplied to the setting register section 250 as a signal SELG<3:0>. In FIG. 30, upon receiving a signal SELGRA<3:0> from the GCLK counter 400-R or a signal SELGRB<3:0> from the GCLK counter 410-R, the setting register section 250 analyzes the grayscale pulse setting register specified by the signal SELGRA<3:0> or SELGRB<3:0> using the decoder 450-R, and returns the data set in the grayscale pulse setting register to the GCLK counter 400-R or the GCLK counter 410-R as GR<7:0> or GRB<7:0>.

The GCLK counter performs the above-described operation in units of one horizontal scan period.

In the GCLK counter, an output from a comparator CMP is set at the H level when the set data G<7:0> is "0". The load value LDVALUE<3:0> becomes "15" when the output from the comparator CMP is set at the H level. Therefore, the grayscale counter CNT2 stops outputting the subsequent grayscale pulse. Specifically, when the value set in the p-th ($1 \leqq p \leqq N-1$, p is an integer) grayscale pulse setting register is a predetermined value ("0", for example), generation of the (p+1)th to N-th grayscale pulses is omitted.

In FIG. 30, since the R component grayscale pulse setting register 262-R is used by the first and second GCLK generation sections 400 and 410, the value GRA<7:0> is the same as the value GRB<7:0>. Since the G component grayscale pulse setting register 262-G is used by the first and second GCLK generation sections 400 and 410, the value GGA<7:0> is the same as the value GGB<7:0>. Since the B component grayscale pulse setting register 262-B is used by the first and second GCLK generation sections 400 and 410, the value GBA<7:0> is the same as the value GBB<7:0>.

Figure 34:
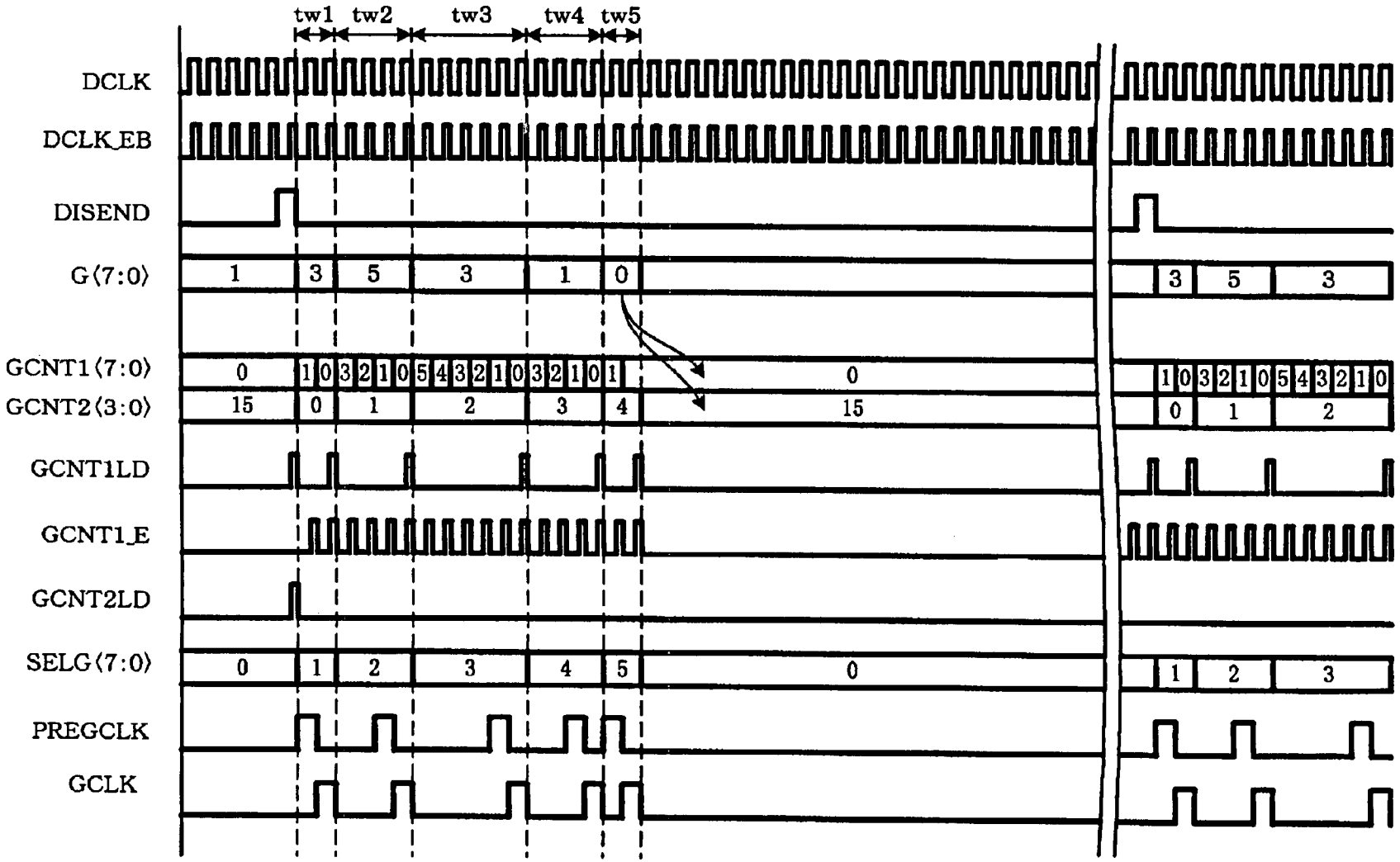
FIG. 34 is a timing diagram of an operation example of omitting output of grayscale pulses.

FIG. 34 is a timing diagram of an operation example of omitting output of the grayscale pulses.

FIG. 34 shows an operation example when the value set in the fifth grayscale pulse setting register is "0". Specifically, since the value set in the fifth grayscale pulse setting register is "0" when the count value GCNT2<3:0> is "4", output of the sixth to fifteenth grayscale pulses is omitted. This enables the present invention to be applied to the case where it suffices that the number of grayscale levels be small.

The present invention is not limited to the above-described embodiment. Various modifications and variations are possible within the spirit and scope of the present invention. For example, the present invention may be applied not only to drive the organic EL panel, but also to drive an electroluminescent panel, a liquid crystal display panel, or a plasma display device.

In the above-described embodiment, the display controller outputs two horizontal blanking adjustment signals and two grayscale clock signals. However, the present invention is not limited thereto. For example, the present invention may be implemented in the case where the display controller outputs three or more of the above-described signals or clock signals.

Part of requirements of any claim of the present invention could be omitted from a dependent claim which depends on that claim. Moreover, part of requirements of any independent claim of the present invention could be made to depend on any other independent claim.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A display controller for controlling first and second data drivers that drive data lines of a display panel including a plurality of scan lines and the data lines, the display controller comprising:

a blanking adjustment signal generation section that generates first and second horizontal blanking adjustment signals for respectively setting first and second horizontal blanking periods, the display controller outputting first and second latch pulse signals to the first and second data drivers during the first and second horizontal blanking periods, respectively, the first and second latch pulses respectively specifying first and second start timings of one horizontal scan period;

first and second horizontal blanking period setting registers in which periods from the first and second start timings of one horizontal scan period changes of the first and second horizontal blanking adjustment signals are respectively set; and a grayscale clock signal generation section that generates a first grayscale clock signal and a second grayscale clock signal, the first grayscale clock signal having first to N-th grayscale pulses within a predetermined period specified by the first horizontal blanking adjustment signal, where N is an integer larger than one, and the second grayscale clock signal having first to N-th grayscale pulses within a predetermined period specified by the second horizontal blanking adjustment signal, the blanking adjustment signal generation section changing the first horizontal blanking adjustment signal when a period corresponding to a value set in the first horizontal blanking period setting register has elapsed from the first start timing, and changing the second horizontal blanking adjustment signal when a period corresponding to a value set in the second horizontal blanking period setting register has elapsed from the second start timing, and the display controller outputting the first horizontal blanking adjustment signal and the first grayscale clock signal to the first data driver that drives the data lines by using a signal that has been pulse-width-modulated based on the first horizontal blanking adjustment signal and the first grayscale clock signal, and outputting the second horizontal blanking adjustment signal and the second grayscale clock signal to the second data driver that drives the data lines by using a signal that has been pulse-width-modulated based on the second horizontal blanking adjustment signal and the second grayscale clock signal.

2. The display controller as defined in claim 1, comprising:

a grayscale pulse setting register for setting an edge of each of the first to N-th grayscale pulses of the first grayscale clock signal, the grayscale clock signal generation section generating the first grayscale clock signal having the first to N-th grayscale pulses, of which an interval between a change timing of the first horizontal blanking adjustment signal and the edge of the first grayscale pulse and an interval between the edge of the (i−1)th grayscale pulse and the edge of the i-th grayscale pulse are set based on a value set in the grayscale pulse setting register, within a predetermined period that starts at the change timing of the first horizontal blanking adjustment signal and ends at a next change timing of the first horizontal blanking adjustment signal, i being equal to or greater than 2, i being equal to or less than N, and i being an integer, and generating the second grayscale clock signal having the first to N-th grayscale pulses, of which an interval between a change timing of the second horizontal blanking adjustment signal and the edge of the first grayscale pulse and an interval between the edge of the (i−1)th grayscale pulse and the edge of the i-th grayscale pulse are set based on a value set in the grayscale pulse setting register, within a predetermined period that starts at the change timing of the second horizontal blanking adjustment signal and ends at a next change timing of the second horizontal blanking adjustment signal.

3. The display controller as defined in claim 1, comprising:

an offset period setting register in which a phase difference between the first and second horizontal blanking adjustment signals is set, the blanking adjustment signal generation section generating the second horizontal blanking adjustment signal that changes earlier than the first horizontal blanking adjustment signal by a period corresponding to the phase difference set in the offset period setting register.

4. The display controller as defined in claim 1, comprising:

first and second vertical blanking period setting registers in which periods from the start timing of one horizontal scan period until change timing of first and second vertical blanking adjustment signals are set, respectively, the first and second vertical blanking adjustment signals being used for respectively setting first and second vertical blanking periods that have the pulses of the first and second latch pulse signals, respectively, the blanking adjustment signal generation section changing the first vertical blanking adjustment signal when a period corresponding to a value set in the first vertical blanking period setting register has elapsed from the start timing, and changing the second vertical blanking adjustment signal when a period corresponding to a value set in the second vertical blanking period setting register has elapsed from the start timing, and the display controller outputting the first and second vertical blanking adjustment signals respectively to first and second scan drivers that drive the scan lines of the display panel including display elements that are discharged based on the first and second horizontal blanking adjustment signals and the first and second vertical blanking adjustment signals.

5. A display system, comprising:

a display panel that includes:

a plurality of scan lines;

a plurality of data lines; and a plurality of electroluminescent elements, each of the electroluminescent elements being specified by one of the scan lines and one of the data lines;

first and second scan driver that scans the scan lines;

first and second data drivers that drive the data lines; and the display controller as defined in claim 4, the display controller outputting the first and second horizontal blanking adjustment signals respectively to the first and second data drivers, and outputting the first and second vertical blanking adjustment signals respectively to the first and second scan drivers, and the electroluminescent elements being discharged based on the first and second horizontal blanking adjustment signals and the first and second vertical blanking adjustment signals.

6. A display system, comprising:

a display panel that includes:

a plurality of scan lines;

a plurality of data lines; and a plurality of electroluminescent elements, each of the electroluminescent elements being specified by one of the scan lines and one of the data lines;

a scan driver that scans the scan lines;

first and second data drivers that drive the data lines; and the display controller as defined in claim 1, the display controller outputting the first horizontal blanking adjustment signal and the first grayscale clock signal to the first data driver, and outputting the second horizontal blanking adjustment signal and the second grayscale clock signal to the second data driver.

7. A display control method for controlling first and second data drivers that drive data lines of a display panel including a plurality of scan lines and the data lines, the display control method comprising:

generating a first horizontal blanking adjustment signal for setting a first horizontal blanking period based on a value set in a first horizontal blanking period setting register in which a period until the first horizontal blanking adjustment signal changes is set;

generating a second horizontal blanking adjustment signal for setting a second horizontal blanking period based on a value set in a second horizontal blanking period setting register in which a period until the second horizontal blanking adjustment signal changes is set;

outputting the first horizontal blanking adjustment signal and a first grayscale clock signal to the first data driver, the first grayscale clock signal having first to N-th grayscale pulses within a predetermined period specified by the first horizontal blanking adjustment signal, where N is an integer larger than one, and the first data driver driving the data lines by using a signal that has been pulse-width-modulated based on the first horizontal blanking adjustment signal and the first grayscale clock signal; and outputting the second horizontal blanking adjustment signal and a second grayscale clock signal to the second data driver, the second grayscale clock signal having first to N-th grayscale pulses within a predetermined period specified by the second horizontal blanking adjustment signal, and the second data driver driving the data lines by using a signal that has been pulse-width-modulated based on the second horizontal blanking adjustment signal and the second grayscale clock signal, the first horizontal blanking period being a period having a pulse of a first latch pulse signal that specifies first start timing of one horizontal scan period, and the second horizontal blanking period being a period having a pulse of a second latch pulse signal that specifies second start timing of one horizontal scan period.

8. The display control method as defined in claim 7, comprising:

based on a value set in an offset period setting register in which a phase difference between the first and second horizontal blanking adjustment signals is set, generating the second horizontal blanking adjustment signal that changes earlier than the first horizontal blanking adjustment signal by a period corresponding to the phase difference set in the offset period setting register.

9. The display control method as defined in claim 7, comprising:

generating the first grayscale clock signal having the first to N-th grayscale pulses, of which an interval between a change timing of the first horizontal blanking adjustment signal and an edge of the first grayscale pulse and an interval between an edge of the (i−1)th grayscale pulse and an edge of the i-th grayscale pulse are set based on a value set in the grayscale pulse setting register, within a predetermined period that starts at the change timing of the first horizontal blanking adjustment signal and ends at a next change timing of the first horizontal blanking adjustment signal where i is equal to or greater than 2, i is equal to or less than N, and i is an integer; and generating the second grayscale clock signal having the first to N-th grayscale pulses, of which an interval between a change timing of the second horizontal blanking adjustment signal and an edge of the first grayscale pulse and an interval between an edge of the (i−1)th grayscale pulse and an edge of the i-th grayscale pulse are set based on a value set in the grayscale pulse setting register, within a predetermined period that starts at the change timing of the second horizontal blanking adjustment signal and ends at a next change timing of the second horizontal blanking adjustment signal.

* * * * *